United States Patent [19]

Frink et al.

[11] 4,110,579

[45] Aug. 29, 1978

[54] IMPROVED ENERGY-STORAGE OPERATING MECHANISMS FOR CIRCUIT-INTERRUPTING STRUCTURES UTILIZING SERIALLY-RELATED DISCONNECTING SWITCH STRUCTURES THEREWITH

[75] Inventors: Russell E. Frink, Pittsburgh; Stanislaw A. Milianowicz, Monroeville, both of Pa.

[73] Assignee: Westinghouse Electric Corp., Pittsburgh, Pa.

[21] Appl. No.: 555,212

[22] Filed: Mar. 4, 1975

Related U.S. Application Data

[62] Division of Ser. No. 469,931, May 14, 1974.

[51] Int. Cl.[2] ..... H01H 33/12; H01H 33/14

[52] U.S. Cl. ..... 200/146 R; 200/148 B; 200/153 SC; 200/148 A

[58] Field of Search ..... 200/146 R, 148 R, 148 B, 200/148 A, 148 H, 148 C, 153 SC

[56] References Cited

U.S. PATENT DOCUMENTS

| | | | |
|---|---|---|---|
| 2,757,261 | 7/1956 | Lingal et al. | 200/148 B |
| 3,071,668 | 1/1963 | Upton, Jr. et al. | 200/146 R |
| 3,154,656 | 10/1964 | Gussow et al. | 200/145 |
| 3,201,551 | 8/1965 | Mercier | 200/146 R |
| 3,311,726 | 3/1967 | Fish, Jr. | 200/148 A |
| 3,433,913 | 3/1969 | Leeds | 200/148 H |
| 3,527,912 | 9/1970 | Jaillet | 200/148 A |
| 3,674,956 | 7/1972 | Erni | 200/148 A |
| 3,735,073 | 5/1973 | Davies | 200/153 SC |
| 3,739,125 | 6/1973 | Noeske | 200/148 A |
| 3,769,477 | 10/1973 | Chabala et al. | 200/146 R |
| 3,769,478 | 10/1973 | Weston et al. | 200/146 R |
| 3,786,215 | 1/1974 | Mauthe | 200/150 G |
| 3,943,314 | 3/1976 | Frink | 200/148 A |
| 4,000,387 | 12/1976 | Milianowicz | 200/148 A |

*Primary Examiner*—Robert S. Macon
*Attorney, Agent, or Firm*—W. R. Crout

[57] ABSTRACT

An improved operating mechanism of the energy-storage type is provided for circuit-interrupting structures, including an energy-storing means having the energy content therein increased by the movement of a movable member during the closing operation, and a collapsible toggle-linkage is provided between the energy-storing means and the separable arcing contact structure of the circuit-interrupter structure. Improved means are provided for a tripping operation, and thereby effecting the collapse of said toggle-linkage to effect the opening of said separable contact structure, and a second releasing means is preferably provided for discharging the stored-energy of the energy-storing means to effect thereby the straightening of said toggle-linkage and the consequent closing of the separable contacts within the circuit-interrupter during the closing operation.

The aforesaid improved operating mechanism is additionally applicable to the situation in which a serially-related disconnecting-switch structure is used in electrical series with the circuit-interrupting structure, so that a visible open-circuit safe gap is provided in the fully-open-circuit position of the device for safety of maintenance personnel.

The energy-storing means, preferably, is provided by suitable spring-means, such as, for example, compression-spring means, which has the energy content therein increased during the closing operation of the circuit interrupter by suitable crank-means, for example, which increases the energy content of the energy-storage means until a certain point in closing travel is reached, at which point releasing means effects an extension of said spring means to thereby effect straightening of the toggle-linkage associated with the contacts of the circuit-interrupter and consequent closing of the separable contacts thereof.

An extension of the movable member, which provides an increase in the energy-storage content of the energy-storage means effects opening and closing movements of a conjointly-acting serially-related disconnecting switchblade.

30 Claims, 43 Drawing Figures

IMPROVED ENERGY-STORAGE OPERATING MECHANISMS FOR CIRCUIT-INTERRUPTING STRUCTURES UTILIZING SERIALLY-RELATED DISCONNECTING SWITCH STRUCTURES THEREWITH

This is a division of application Ser. No. 469,931 filed May 14, 1974.

CROSS REFERENCES TO RELATED APPLICATIONS

Reference may be had to the following patent applications: U.S. patent application filed May 13, 1974, Ser. No. 469,586, now U.S. Pat. No. 4,000,387, issued Dec. 28, 1976 to Stanislaw A. Milianowicz relating to the interrupting structure of the device; U.S. patent application filed May 3, 1974, Ser. No. 466,475, now U.S. Pat. No. 3,932,715, issued Jan. 13, 1976 to Steven Swencki and Stanislaw A. Milianowicz; U.S. patent application filed July 31, 1967, Ser. No. 657,122, now U.S. Pat. No. 3,588,407, issued June 28, 1971 to Russell E. Frink, all of the foregoing patent applications being assigned to the assignee of the instant patent application.

Also, U.S. patent application filed Sept. 11, 1973, Ser. No. 396,163, now U.S. Pat. No. 3,875,355, issued Apr. 1, 1975 to Russell E. Frink, et al., covers an improved corrosion-resistant contact hinge-structure related to the hinge end of the movable disconnecting switchblade when a disconnecting switch is utilized with the interrupter device of the present invention.

Moreover, U.S. patent application filed May 14, 1974, Ser. No. 469,932, now U.S. Pat. No. 3,943,314, issued Mar. 9, 1976 to Russell E. Frink, relates to a lazy-tong, or pantograph operating mechanism, and an improved operating seal for a sealed-type of interrupter unit or casing, which provides a considerably long movable contact-travel distance with a relatively short minimal axial initiating operating movement of the connecting rod, which initiates movement of the lazy-tong linkage, for example, from the improved operating mechanism of the present invention.

BACKGROUND OF THE INVENTION

Load-break disconnecting switches are quite old in the art, and in some instances employ an interrupting unit having separable interrupting arcing contacts in electrical series with the disconnecting switchblade to interrupt the incident arcing at the separable interrupter arcing contacts instead of at the disconnecting-switch contacts. The prior-art devices function to first effect initial opening of the interrupting assembly, and, subsequently, effect opening of the serially-related disconnecting switchblade without arcing thereat to completely isolate the circuit. U.S. Pat. No. 2,769,063, issued Oct. 30, 1956, to H. J. Lingal, is typical of such series-type devices. Other load-break disconnecting devices, which utilize a swinging movement of the free end of the disconnecting switchblade to effect the operation of the operating mechanism for the interrupting element, are set forth, for example, in U.S. Pat. No. 2,889,434, issued June 2, 1959, to H. J. Lingal, and assigned to the assignee of the instant application.

In some of the aforesaid load-break disconnecting switches, an insulating gas, such as sulfur-hexafluoride ($SF_6$) gas, for example, is utilized for arc-extinguishing purposes. In still other devices, such as set forth in U.S. Pat. No. 2,737,556, issued Mar. 6, 1956, to MacNeill et al, a suitable arc-extinguishing liquid, such as oil, for example, may be utilized to advantage, although, as is well known, oil gives rise to the hazard of inflammability if the oil container, or oil casing, should for some reason, fracture due to earthquake shock, vibration, gun shot, or from any other causes, and spill flammable oil into the surrounding switchyard area.

Modern circuit-breakers are efficient and reliable devices and perform their duties adequately. However, they are large and expensive; and in many cases, economies can be achieved with less-expensive devices. Such devices have been available for several years and range from load-interrupter switches, with interrupting ratings approximating their continuous current-carrying capabilities, to devices which can interrupt a few thousand amperes with modest transient-recovery voltage capabilities.

Over the past few years, development work performed with sulfur-hexafluoride ($SF_6$) gas puffer-type circuit-interrupters has led to improvements in these puffer gas-type devices. Some of these improvements have been incorporated into the medium-fault-interrupting class devices, such as set forth in the instant patent application, thus expanding their field of application. Some of the advantages attained by the invention set forth herein include:

(a) Simplicity of construction;
(b) 10,000 amperes interrupting capacity at 169 KV, for example, on a single contact break without using shunt capacitors or resistors;
(c) Transient-recovery capability on bus-faults corresponding to capability of circuit-breakers at maximum rating;
(d) Full insulation strength across the open contacts of the interrupter without requiring an open disconnecting switch;
(e) High-speed circuit-making and breaking in pressurized $SF_6$ gas which eliminates any arcing in air;
(f) Low noise level during switch operation.

Accordingly, it is desirable to improve upon the operating mechanism of such load-break disconnecting switches, or interrupter switches, per se, when used alone, and the present invention is particularly concerned with such an improved mechanism device utilizing a unique energy-storage means and having wide areas of application.

SUMMARY OF THE INVENTION

In accordance with the present invention, there is provided an improved energy-storage means for a circuit-interrupter operating mechanism, such as a suitable compression spring means, for example, which translates closing rotative driving movement of one of the insulator columns to effect charging of such an energy-storage means to increase the energy content stored therein. Upon a suitable point in time reached during the closing operation of the device, suitable first releasing means are actuated to thereby effect release of the energy-storage means to cause a longitudinal, or lateral contact-closing movement, for example, of a latched collapsible toggle-linkage, which thereby effects the closing of the separable arcing contact structure within the serially-related interrupting unit against an opposing accelerating opening-spring pressure.

The coordination provided by the improved operating mechanism between the swinging opening-and-closing movements of the disconnecting switchblade is such as to effect closing of the swinging switchblade prior in point of time to the closing of the separable contact arcing structure disposed within the serially-related interrupting unit or casing. Also, during the opening operation, the arcing contact structure within the interrupting unit is opened prior in point of time to the subsequent opening of the swinging disconnecting switchblade, which effects a desired isolation of the controlled electrical circuit. As a result, all deleterious arcing occurs only at the arcing contacts within the interrupting unit, which are fully capable of effecting extinction of such arcing, rather than at the exposed separable disconnecting contacts of the swinging disconnecting switchblade, the function of which is restricted to an isolating purpose only.

As a result, the improved operating mechanism of the present application may be used either with, or without a serially-related disconnecting-switch structure. It is merely necessary to provide an extension of the operating-shaft structure to afford the necessary cranking movement to effect the operation of a serially-related disconnecting switchblade, if, for certain reasons, the presence of a serially-related disconnecting-switch structure is desired by the utility customer for safety reasons.

DESCRIPTION OF THE PREFERRED EMBODIMENTS

Modern circuit-breakers are efficient and reliable devices and perform their duties adequately. However, they are large and expensive; and in many cases, economies can be achieved with less-expensive devices. Such devices have been available for several years and range from load-interrupter switches, with interrupting ratings approximating their continuous-current-carrying capabilities, to devices, which can interrupt a few thousand amperes with modest transient-recovery capabilities.

Over the past few years, development work performed with sulfur-hexafluoride ($SF_6$) gas-puffer-type circuit-interrupters has led to improvements in these gas-type devices. Some of these improvements have been incorporated into medium-fault-interrupting class devices, such as set forth in the instant patent application, thus expanding their field of application. Some of the advantages, attained by the invention set forth herein, include:

(a) Simplicity of construction;
(b) 10,000 amperes interrupting capacity at 169 KV, for example, on a single-break interrupter without using shunt capacitors or resistors;
(c) Transient-recovery voltage capability on bus faults corresponding to capability of circuit-breakers at maximum rating;
(d) Full insulation strength across the open contacts of the interrupter without requiring an open disconnect switch;
(e) High-speed circuit making and breaking in pressurized sulfur-hexafluoride ($SF_6$) gas eliminates any arcing in air;
(f) Low noise level during switch operation.

Figure 1:
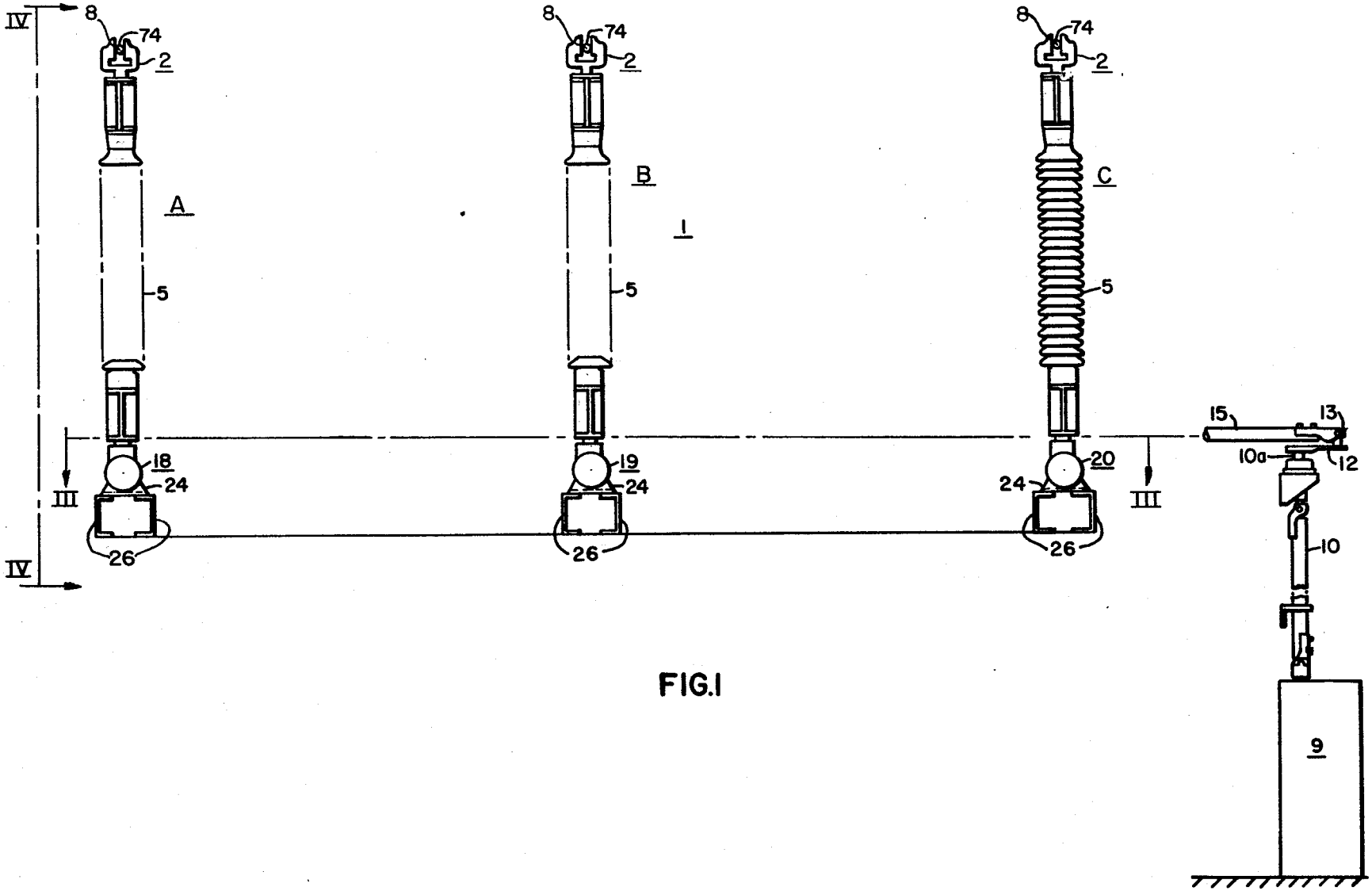
FIG. 1 is an end elevational view of the three poles of a three-phase circuit-interrupting assemblage, illustrating each of the pole-units in the electrically-closed-circuit position, and showing the mechanically-interconnecting linkage extending between the three pole-units and the motor-operated mechanism associated therewith, the linkage structure being likewise illustrated in the closed-circuit position.
Figure 2:
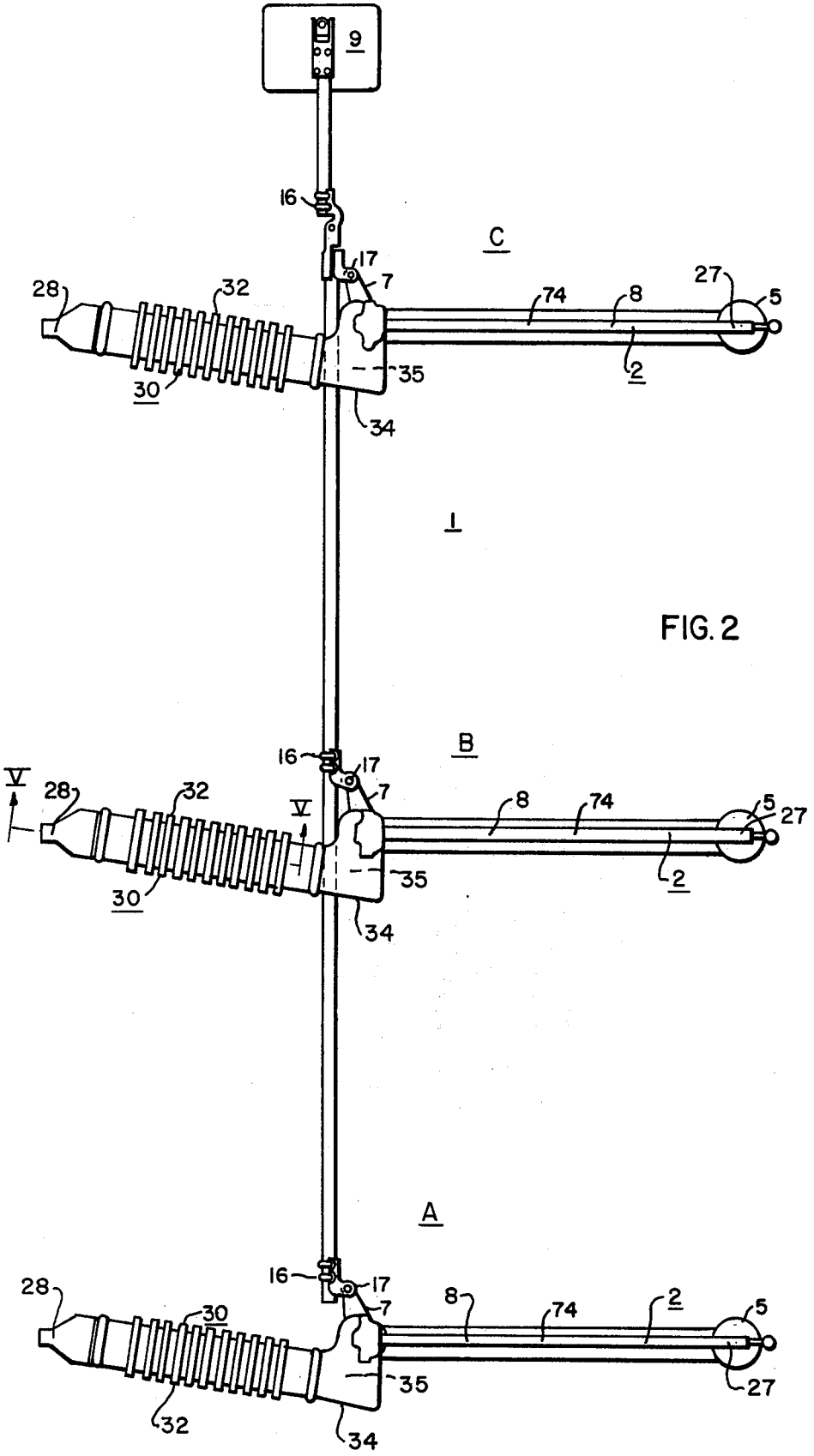
FIG. 2 is a top plan view of the three-phase circuit-interrupting assemblage of FIG. 1, looking downwardly upon the three pole-units, with the supporting structure omitted for clarity, again the disconnecting contact-blade and the mechanically-interconnecting linkage being illustrated in the electrically-closed-circuit position.
Figure 3:
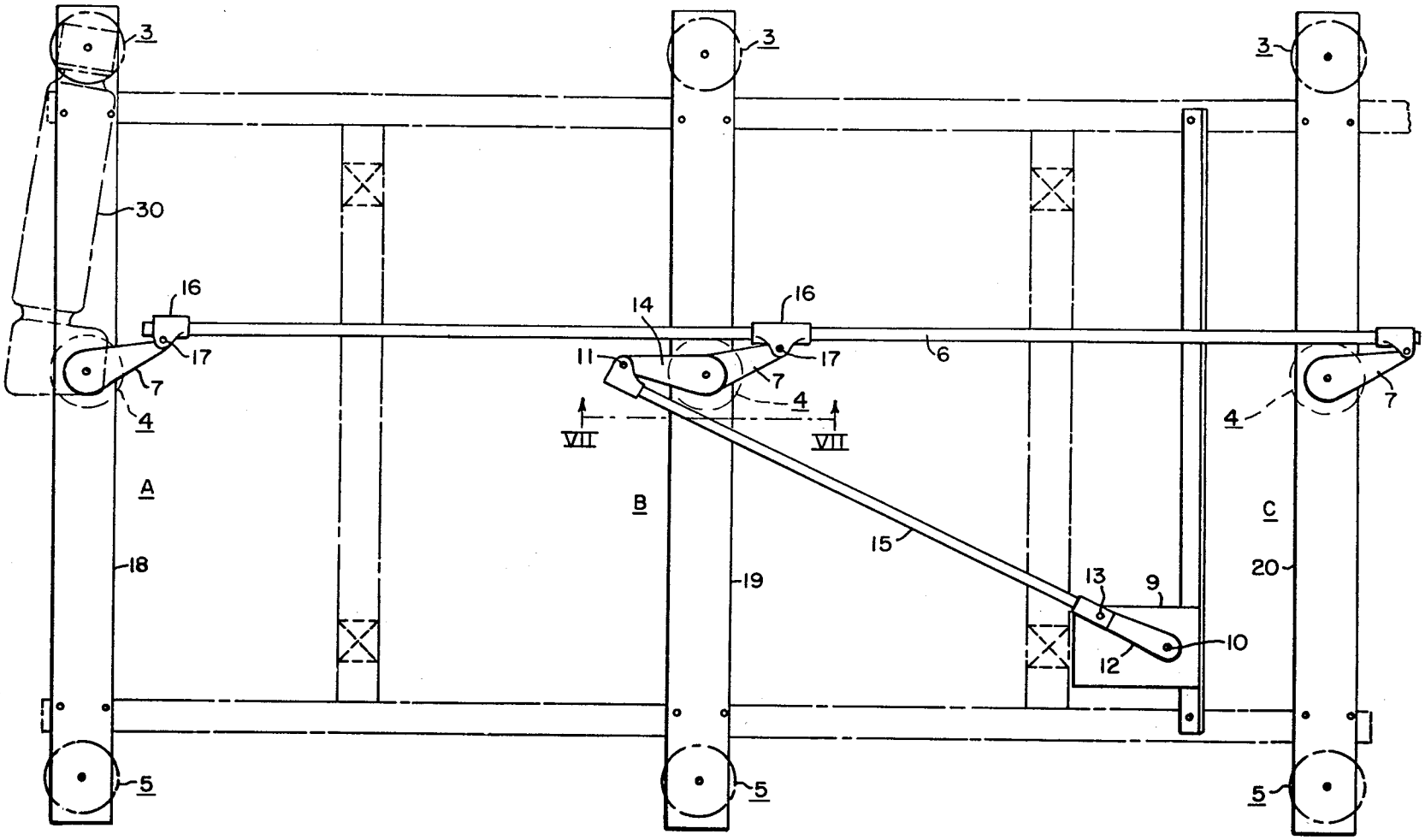
FIG. 3 is a top plan sectional view of the interconnecting linkage for operating the three pole-units in unison, the section being taken generally along the line III—III of FIG. 1, with some of the column structures being diagrammatically illustrated, and the end interrupting unit also being diagrammatically illustrated, the entire device being shown in the closed-circuit position.
Figure 4:
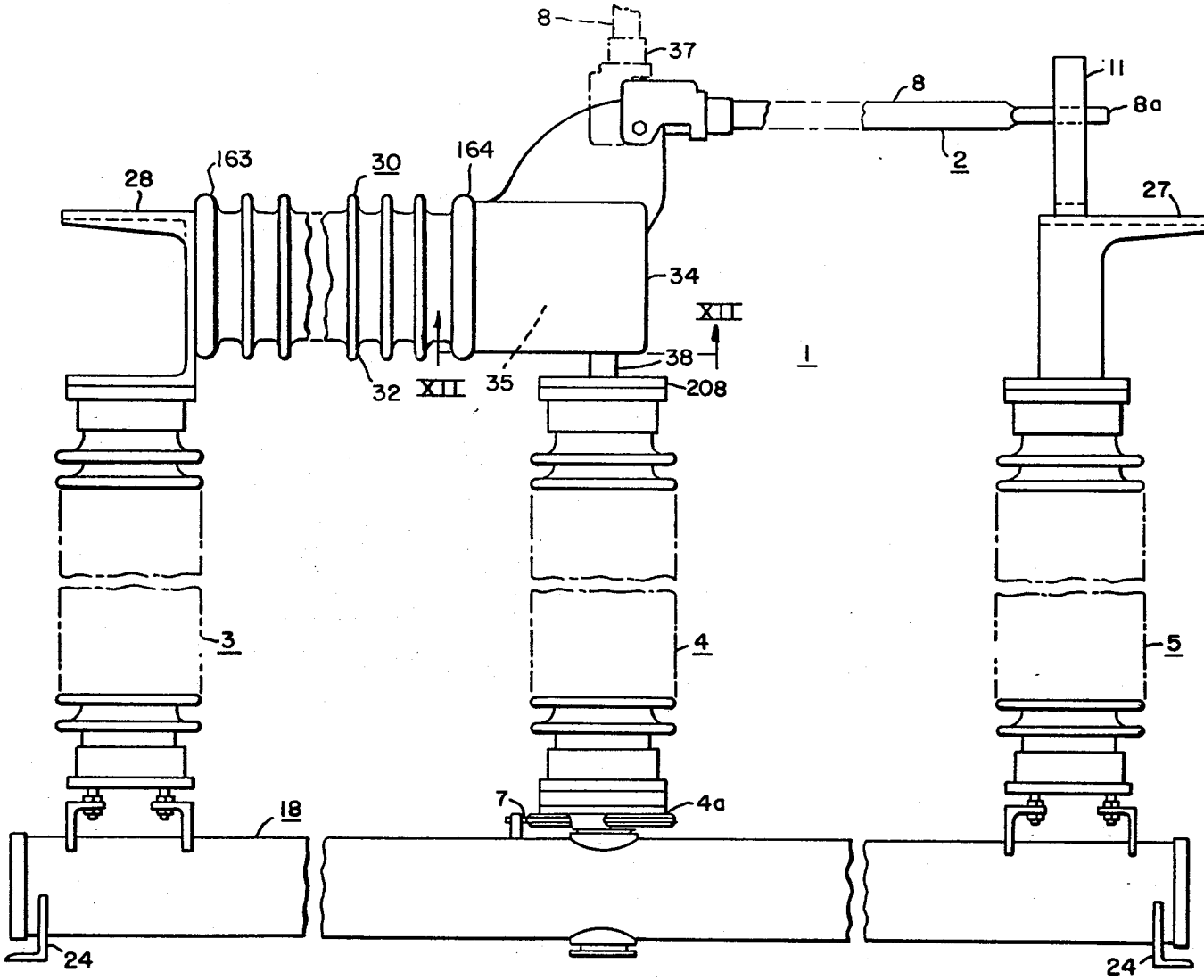
FIG. 4 is a side-elevational view of the end pole-unit of the three-phase circuit-interrupting assemblage of FIGS. 1-3, taken generally along the section line IV—IV of FIG. 1, having a serially-related disconnecting switchblade, the device being shown in the closed-circuit position.

Referring to the drawings, and more particularly to FIGS. 1–4 thereof, the reference numeral 1 generally designates a circuit-interrupting structure including three upstanding post insulators 3, 4 and 5 (FIG. 4). The two end post insulators 3 and 5 being stationary, whereas the middle post insulator 4 is rotatable, being driven from its lower end by an operating-crank 7 (FIGS. 2 and 3) connected to any suitable operating mechanism 9, as shown in FIGS. 1 and 3. Such an operator 9 may be a motor-driven device, or in certain instances the crank-operator 9 may be manually driven.

In more detail, the operating mechanism 9, which may be of any suitable type, effects rotation of a vertically-extending operating shaft 10, to the upper end of which **10*a* (FIG. 1) is affixed a rotatable crank-arm 12. To the outer free end of the crank-arm 12 is pivotally connected, as at 13, an interconnecting horizontally-disposed operating rod 15, the latter being pivotally connected to an actuator 14 (FIG. 3) at pivot point 11. The several operating cranks 7 are consequently mechanically connected by a rod 6 (FIG. 3) to act in unison. The several operating cranks 7 are associated with the lower ends 4*a* of each of the three middle rotatable operating insulator posts 4 of the three pole-units "A," "B" and "C" of the three-phase circuit interrupter 1**.

FIG. 1 also shows the three base supporting structures 18, 19 and 20, which may be of cylindrical form, and are supported by welded brackets 24 to cooperating channel members 26, which face inwardly as illustrated in FIG. 1.

Figure 5:
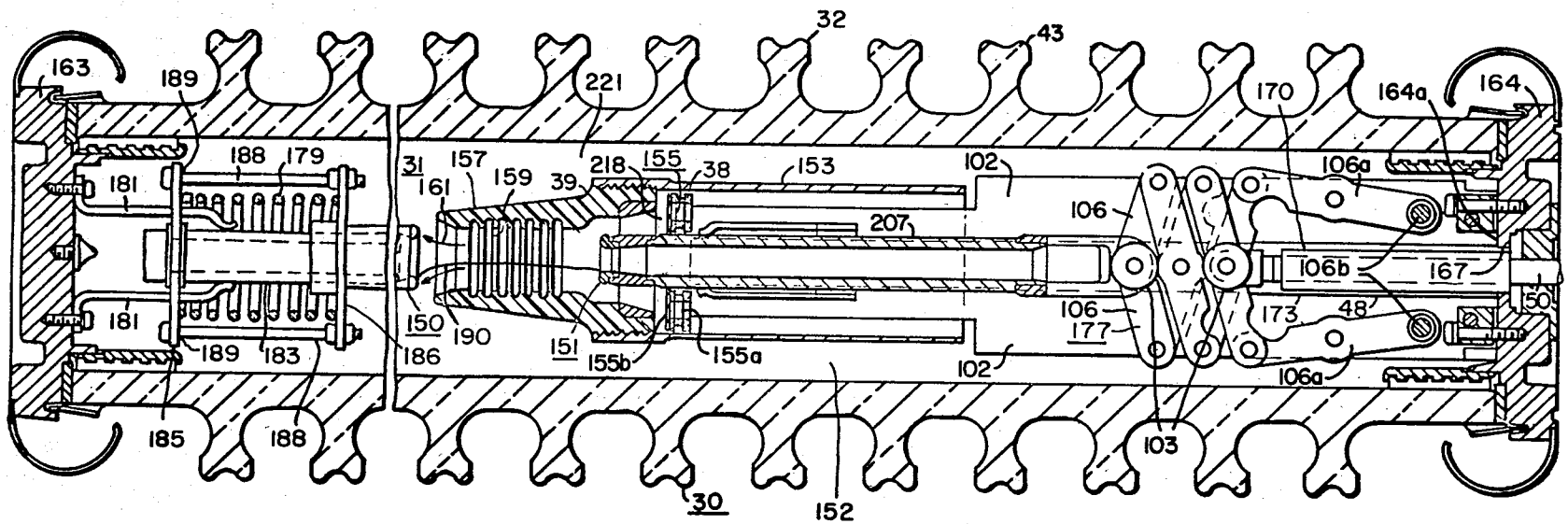
FIG. 5 is an enlarged longitudinal vertical sectional view taken longitudinally through the circuit-interrupter assembly extending between the two upstanding support column structures of FIG. 2, along the line V—V of FIG. 2, the contact structure being illustrated in the fully-open-circuit position, but for illustrative purposes only, the gas-flow being indicated by the arrows within the gas-nozzle structure.

Extending between each end post insulator 3 and the middle rotatable driving post insulator 4 is an interrupting assembly, or a circuit-interrupter 30 (FIGS. 2 and 4), which encloses one or more serially-related separable contact structures 31 (FIG. 5), which may be of any suitable type— for instance, of the gas-puffer type set forth in FIG. 5 of the drawings, which may, for example, use sulfur-hexafluoride ($SF_6$) gas.

Referring again to the drawings, and more particularly to FIGS. 3 and 4 thereof, it will be observed that one application of the present invention is in connection with a circuit-interrupting device 30 (FIG. 5) having a serially-related disconnecting switchblade 8 associated therewith for obvious safety reasons. Those skilled in the art may call such a structure a "load-break disconnecting switch," in which the circuit-interrupting structure 30 is utilized to actually break the load-current passing through the device 1, and the function of the disconnecting switchblade 8 itself is merely to effect a visible open-circuit condition of the device 1, so that maintenance people may work upon the connected electrical line without fear of high-voltage shock occurring.

As illustrated in FIG. 4, it will be observed that there is provided a lower-disposed base-assembly 18 having supporting brackets 24 and having welded to the upper portion thereof additional brackets 21, 23 to fixedly support the insulating column structures 3 and 5.

With reference to FIG. 4, it will be observed that extending upwardly from the elongated base support 18, which may be of generally tubular configuration, if desired, are stationary insulating columns 3 and 5, which support a right-hand line-terminal 27 and a left-hand load-terminal 28, with a circuit-interrupting assemblage 30 enclosed within a hermetically-sealed housing 32 extending between the load-terminal 28 and a generally box-shaped metallic mechanism housing 34, which has a mechanism 35 disposed therewithin, a description of which will be given hereinafter. Electrically interconnecting the metallic mechanism housing 34 and the line-terminal 27 is a swinging disconnecting switchblade 8, which provides an open-circuit visible gap between the line-terminal 27 and the mechanism housing 34 in the fully open-circuit position of the circuit-interrupter 30. The dotted lines 37 indicate, generally, an upstanding open-circuit position of the disconnecting switchblade 8, as well known by those skilled in the art.

Figure 10:
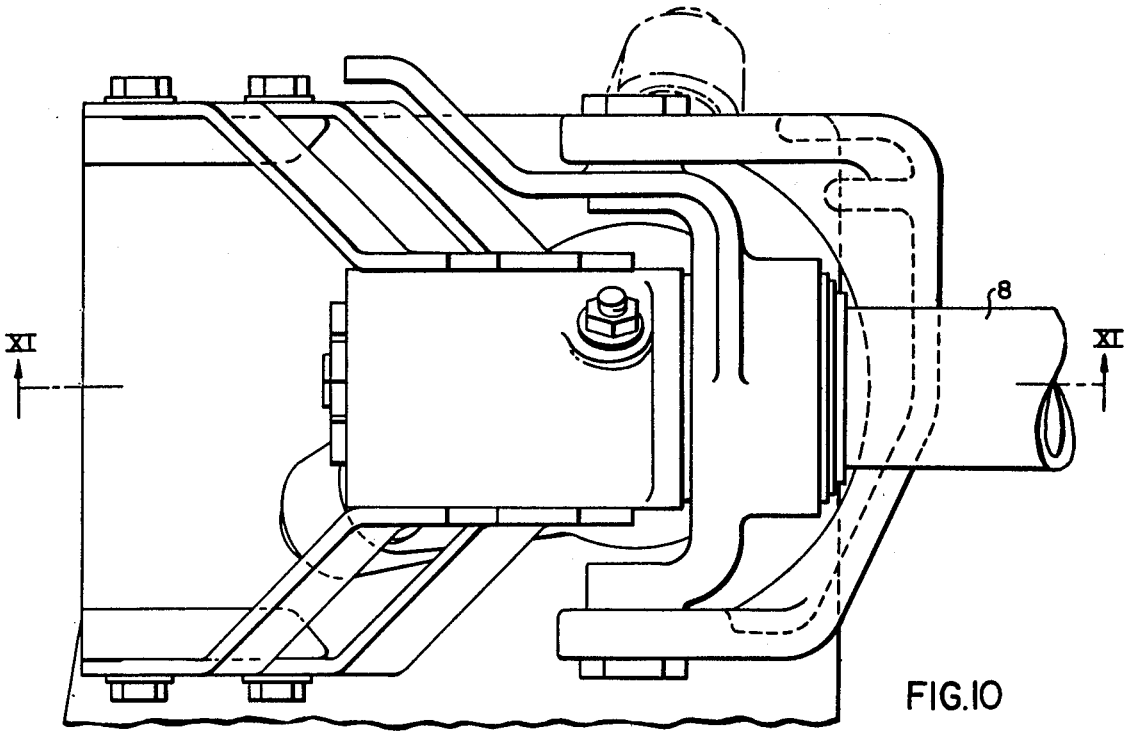
FIG. 10 is a fragmentary top plan view of a portion of the hinge-end crank-operator for operating the movable swinging disconnecting switchblade; the parts being illustrated in the switch-closed position.
Figure 11:
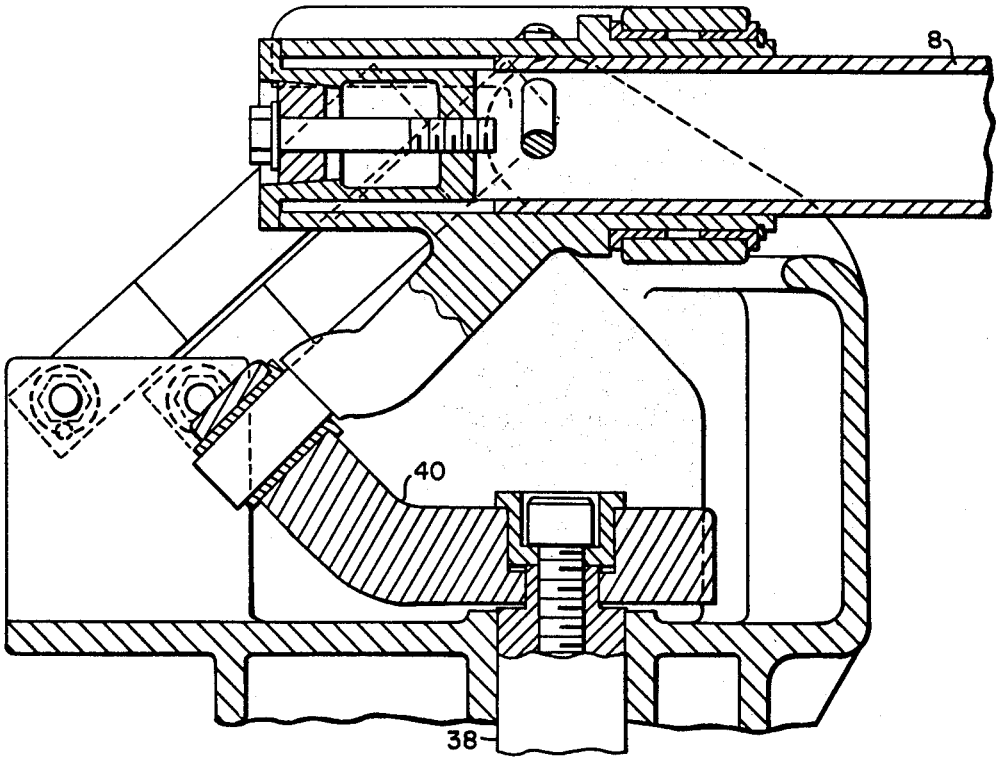
FIG. 11 is a fragmentary vertical sectional view taken substantially along the line XI—XI of FIG. 10.

It will be observed that the end insulating columns 3 and 5 are stationary, merely providing a supporting function, whereas the middle insulating column 4 is rotatable, and has an operating function, having an upper extending shaft-portion 38, which extends interiorly within the mechanism housing 34, and serves to actuate the operating mechanism 35 provided therein. The upstanding operating shaft 38 extends, moreover, upwardly through the mechanism housing 34, terminating in a crank-arm 40 (FIG. 11), and actuates the opening swinging motion of the disconnecting switchblade 8. FIGS. 10 and 11 may be referred to, to more clearly illustrate the crank-arm 40 construction. In other words, the upper end of the operating shaft 38 effects rotative opening and closing movements of the crank-arm 40, which, in turn, effects rotation and swinging opening and closing vertical motions of the serially-related disconnecting switchblade 8.

THE CIRCUIT INTERRUPTER 30

Figure 6:
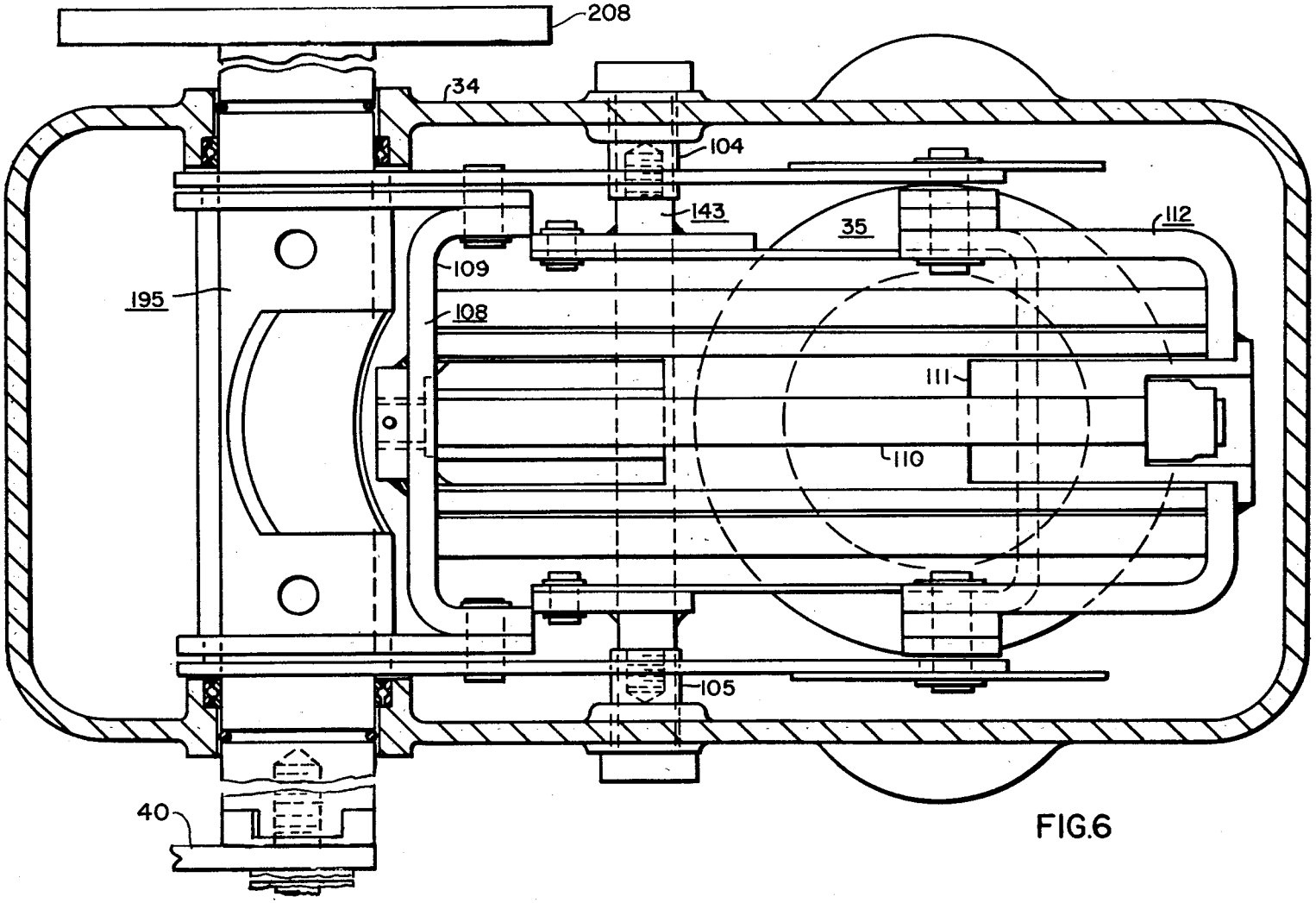
FIG. 6 is a vertical sectional view taken substantially along the line VI—VI of FIG. 14, the interrupter and disconnecting switch being illustrated in the closed-circuit position.

With reference to FIG. 6 of the drawing, it will be observed that the separable contact structure 31 comprises a spring-biased stationary contact 150 and a movable tubular contact structure 151, which carries an operating cylinder 153 over a relatively stationary piston structure 155. In addition, the movable tubular contact 151 carries an orifice structure 157 having a corrugated opening 159 therethrough, through which gas 152, such as $SF_6$ gas, for example, is forced during the opening gas-moving motion of the operating cylinder 153 over the stationary piston structure 155 to thus force the gas to flow in the direction indicated by the arrows 161 in FIG. 5.

Generally, the interrupting assemblage 30 includes a longitudinally-extending casing 32 of insulating material having sealed to the ends thereof metallic end-cap structures 163, 164. The left-hand metallic end-cap structure 163 is electrically connected to the left-hand load-terminal 28 of the switch structure. The right-hand metallic end-cap structure 164 has an opening 167 extending therethrough, which accommodates a metallic bellows 170 and a metallic operating contact rod 173. One end of the metallic bellows 170 is sealed to the inner face **164*a* of the opening 167 of the metallic end-cap structure 164. The other, or left-hand end of the metallic bellows 170 is secured in sealing relationship to the movable metallic contact operating rod 173, which extends into the mechanism compartment 175, and is actuated by the operating mechanism 35**, constituting the present invention.

In the closed-circuit position of the device, not shown, the lazy-tong or pantograph linkage mechanism 177 is somewhat extended, and forces the movable tubular contact 151 into closed contacting engagement with the stationary tubular contact 150, and somewhat compressing the contact-compression spring 179. Relatively stationary contact fingers 181 slide upon the supporting cylinder 183, which carries the relatively stationary contact 150 at its right-hand end in the manner illustrated in FIG. 5 of the drawings.

A support plate 185 is fixedly supported by mans not shown from the left-hand metallic end-cap structure 163, and the contact-compression spring 179 seats thereon. The right-hand end of the contact compression spring 179 seats upon a movable spring seat 186, which is affixed to a plurality of spring-rods 188, which are capable of sliding through openings 189 provided in the stationary spring seat 185.

The relatively fixed piston structure 155 comprises a ring-shaped metallic member having a plurality of annularly-arranged apertures **155*a* provided therethrough, which cooperate with a ring-shaped valve plate, designated by the reference numeral 155*b*. Biasing means are provided to bias the slap valves 155*b* into closed engagement over the apertures 155*a* provided in the fixed piston member 155, and such biasing means assumes the form of a flexible resilient concave metallic plate. A plurality of valve posts may be provided, being threadably secured into a pair of diametrically-opposed mounting-blocks, which, in turn, are bolted to the side flange portions of four metallic angle members 102 having their right-hand ends secured to a pair of mounting blocks, the latter being bolted to the right-hand end plate 164 of the interrupting assembly 30**.

In more detail, FIG. 5 illustrates the construction of the four angle-shaped support standards 102 which not only provide a fixed support for the fixed piston structure 155 but, additionally, provide a fixed race track for the rollers 103, which pivotally secure the links 106 comprising the lazy-tong motion-multiplying mechanism 177.

The lazy-tong mechanism 177 comprises a plurality of pairs of links 106 which are pivotally connected together by roller pins, the rollers being guided by the side flange portions of the angular standards 102 during their extension and retrieving motions. The right-hand links **106*a* have their right-hand ends pivotally mounted upon fixed pivot pins 106*b*, the latter extending laterally through the side flanges of the mounting standards 102, as more clearly illustrated in FIG. 5 of the drawings. A pair of desiccant housings are provided, designated by the reference numeral 36**, and containing a suitable chemical for drying and purifying the arced $SF_6$ following arcing.

The dash-pot assembly 184 comprises a movable piston member 182 fixedly secured to a sleeve portion 180, the latter fixedly secured to the operating rod 173 extending externally of the casing structure 32, and connected to the operating mechanism 35. The dash-pot structure cushions for opening operation, which, as mentioned, is accelerated by the biasing action exerted by the compression springs 211, 212 bearing against the spring plate 174.

The nozzle structure 157 is fixedly secured to the movable contact structure 151 by the intermediary of an apertured support ring, integrally formed with the movable contact tip, and fixedly secured within a recess portion provided at the right-hand end of the nozzle structure 157. One or more setscrews may be provided to additionally anchor the apertured support ring into place. As will be evident in FIG. 5, the tip portion of the movable contact 151 may be secured, as by a threaded connection, to the left-hand end of the operating rod 173. Thus, the entire movable assembly, comprising the nozzle 157, puffer operating cylinder 153, and movable contact structure 151 are fixedly secured together, and operate as a unit by means of the series operating rods 207, 173, and the intervening lazy-tong mechanism 177 disposed therebetween.

By way of retrospect, during the opening operation, rightward opening separating motion of the movable contact structure 151 from the stationary contact structure 150 occurs, following lost-motion travel of the stationary conact. This provides a desirable pre-compression of the gas within the region 218, prior to the valve-like separation of the movable contacts 150, 151. At this point of time occurs arcing, and a release of the gas through both of the tubular vented contacts 150, 151, now separated, and causing an extension of the terminal ends of the arc into the interior, and along the inner side walls of the two vented contacts 150, 151.

Continued rightward opening movement of the movable contact assembly forces additional gas through the separated contacts 150, 151, and blasting the gas longitudinally against the arc. Arc extinction quickly ensues, and the movable contact structure 151 moves to its fully open-circuit position, as shown in FIG. 5, with the lazy-tong mechanism 177 fully collapsed, as shown in FIG. 5. Subsequently, the operating arrangement is such as to effect swinging upward disconnecting motion of the disconnecting switch plate 8 away from its cooperating stationary disconnecting contact 11 to the upward disconnecting position, as shown more clearly by the dotted lines 37 in FIG. 4.

From the foregoing description, it will be apparent that there has been provided an improved interrupting switch, in which improved arc extinction at high voltages and at high amperage currents occurs by the novel relationship of the parts. The fact that the operating puffer cylinder 153 is of insulating material is very important in withstanding voltage breakdown in the open-circuit position, as illustrated in FIG. 5 of the drawing. Additionally, the desirable precompression of gas within the region 218 prior to contact break is a desirable attribute, since it builds up pressure during a time when the arc length is not adequate enough for arc extinction. It is only when the arc length is of an adequate length necessary for interruption, that the gas release comes into play and quickly effects arc extinction.

To measure the pressure interiorly within the casing structure 32, preferably a pressure gauge 204 (FIG. 42) is provided supported at the left-hand end plate 163 and visible at ground level, as well known by those skilled in the art. This will enable an observer to check on the gas pressure interiorly of the casing 32 to determine whether replacement of gas is required.

As will be obvious from an inspection of the interrupter 30 of FIG. 5, extension of the lazy-tong linkage 177 brings the tubular contacts 150, 151 into closed contacting engagement to close the electrical circuit through the device 30, whereas retraction of the lazy-tong linkage 177, as caused by rightward movement of the operating rod 173 driven from the mechanism 35, will effect opening of the tubular contact structure 150, 151 with concomitant piston-driving gas-flow 152 action through the tubular orifice 157 to effect extinction of the arc 190, which is established between the contacts.

Although FIG. 5 shows the fully-open-circuit position of the tubular contact structure 31, nevertheless for purposes of clarity, the position of the arc 190 has been indicated to show that it is acted upon by the gas flow forced in the direction of the arrows 161 by the movable operating cylinder 153 sliding longitudinally over the stationary piston structure 155.

The improved circuit-interrupting structure 30 has been tested experimentally. It has been found to interrupt 10,000 amperes R.M.S. symmetrical at a voltage of up to 169 K.V., with three-cycle interruption. The rates of rise of the recovery-voltage transient were in excess of 1,600 volt per microsecond. We have also interrupted asymmetrical currents of 12,000 to 16,000 amperes R.M.S. asymmetrical at voltages up to 169 K.V. in three cycle, total interruption time. The pressure within the casing 32 was 75 p.s.i. sulfur-hexafluoride gas. The maximum arcing time on all of the tests was $1\frac{3}{4}$ cycle. We made a total of 21 interruptions of the above currents, without any maintenance or change of gas. The contacts, upon examination, were in excellent condition. In addition, magnetizing-current tests were conducted together, with capacitor-switching tests, as well as the previously-mentioned short-circuit tests.

Prior to the use of the insulating cylinder 153, we were not able to interrupt currents at voltages, which have been achieved above. It is thought that there are two reasons for the improved performance: (1) its improved dielectric field shape, and the other, which is perhaps more important, (2) high electrostatic gradients are kept within the gas, and not impressed upon the solid insulating material of the nozzle 157. Prior to using the present construction, the nozzle 157 would be punctured, or ruptured; and the result was a failure of the interrupter to perform. The 169 K.V. voltages, referred to before, are three-phase line-to-line voltages, appropriate to this type of equipment. One of the reasons of successful interruptions is the fact that the contact 150 follows the contact member 151 at the beginning of the opening motion. This continues for the distance of some $1\frac{3}{4}$ of an inch, or say some distance. During this period of time, the gas in the piston and cylinder chamber is pre-compressed, so that when contact part occurs, the gas is able to flow immediately with a good pressure differential between the cylinder-piston chamber and the ambient. The gas flow is then directed into the dual nozzles 150, 151 of approximately equal configuration and size. It flows in two opposing directions into the ambient chamber 221. Energy for operating the interrupting device is supplied by the rod 173, which moves through the Sylphon bellows, which is welded, or brazed to the end plate 164. Since the axial motion possible through a Sylphon bellows 170 is comparatively short, compared to the desired total longitudinal motion of the interruption device, a motion-multiplier, consisting of a system of links, as shown at 106, is incorporated. Using this system of links, multiplies the motion of the rod 173 by a factor of five. It is desirable with a device, such as described, that it shall be housed in a porcelain housing, and as near to absolutely leak-proof as possible. Referring again to the use of the Sylphon bellows, and the motion-multiplier, it is an approximate rule that the axial length of a Sylphon bellows is five times as long as its total motion. In the interrupter, which is described, a total motion of the contacts of 7 inches is desired, and if we apply the five-times rule, we would have a Sylphon bellows, which was 35 inches long, which is completely out of the question. As used, we have a Sylphon bellows 170 which has a capability of moving one and one half inches, which means that the Sylphon bellows 170 is approximately 7½ inches long. By use of the motion-multiplier, this 1½ inches of motion of the rod 173 is multiplied to a contact motion 151 of 7½ inches.

OPERATING MECHANISM

The improved operating mechanism 35 provided for the circuit-interrupter 30 includes a latched collapsible toggle-linkage 200, which is moved laterally by a closing-spring energy-storage means 203 to close the separable contacts 31 within the circuit-interrupter unit 30. Preferably, an energy-storage means is provided, such as a closing-compression-spring means 203, for example, to effect such lateral closing movement of the aforesaid latched collapsible toggle-linkage 200 to thereby close the separable contacts 31 within the interrupting unit 30. In the improved mechanism 35 provided for the interrupter 30, the energy-storage means 203 is actuated by the closing rotative charging movement of a power-device employed to effect operation of the switch structure 30.

Improved means, to be described subsequently, are provided for effecting a tripping opening operation of the switching device 30, including a tripping, or a releasing of certain first latching means 125, which will be operated upon by any slight rotative movement of the operating mechanism 35 for the improved circuit-interrupter 30.

In further accordance with the improved operating mechanism 35 provided for the interrupter 30 and for a subsequent opening of the disconnecting contact-blade 8, there is provided an energy-storage means, such as suitable closing compression-spring means 203, which translates closing rotative driving movement of the central insulator column 4 to effect charging of such an energy-storage means 203 to increase the energy content stored therein. Upon a suitable point in time during the closing operation, suitable second releasing means 209 are actuated to thereby effect release of the energy-storage means 203, to thereby cause a lateral contact-closing movement of the latched toggle-linkage 200, which thereby effects closing of the separable contact structure 31 within the serially-related interrupting unit 30, against the opposition afforded by an opening accelerating spring-means 211, 212. The opening accelerating spring-means 211, 212 is, of course, of weaker construction, and affords less of a biasing action, than the aforesaid mentioned energy-storage means 203 constituted by the closing-spring assemblage 121, 122. The coordination provided by the operating mechanism 35 between the swinging opening and closing movements of the disconnecting switchblade 8 is such as to effect closing of the swinging disconnecting switchblade 8 prior to a subsequent closing of the separable contact structure 31 disposed within the serially-related interrupting unit 30.

It is to be furthermore noted that during the opening operation, the contact structure 31 within the interrupting unit 30 is opened prior to the subsequent opening of the swinging disconnecting switchblade 8, which effects a visible isolation gap 37 inserted into the controlled electrical circuit. As a result, all deleterious arcing occurs at the contacts 31 within the interrupting unit 30, which is in and of itself fully capable of effecting extinction of such arcing 190, rather than at the exposed separable disconnecting contacts **8*a*, 11 of the swinging disconnecting switchblade 8, the function of which is restricted to an isolating purpose, or function only. Conversely, during the closing operation all deleterious effects of prestriking electrical arcing occur within the chamber 32 of the interrupting unit 30, while the disconnecting blade 8** is already in a closed position.

Figure 15:
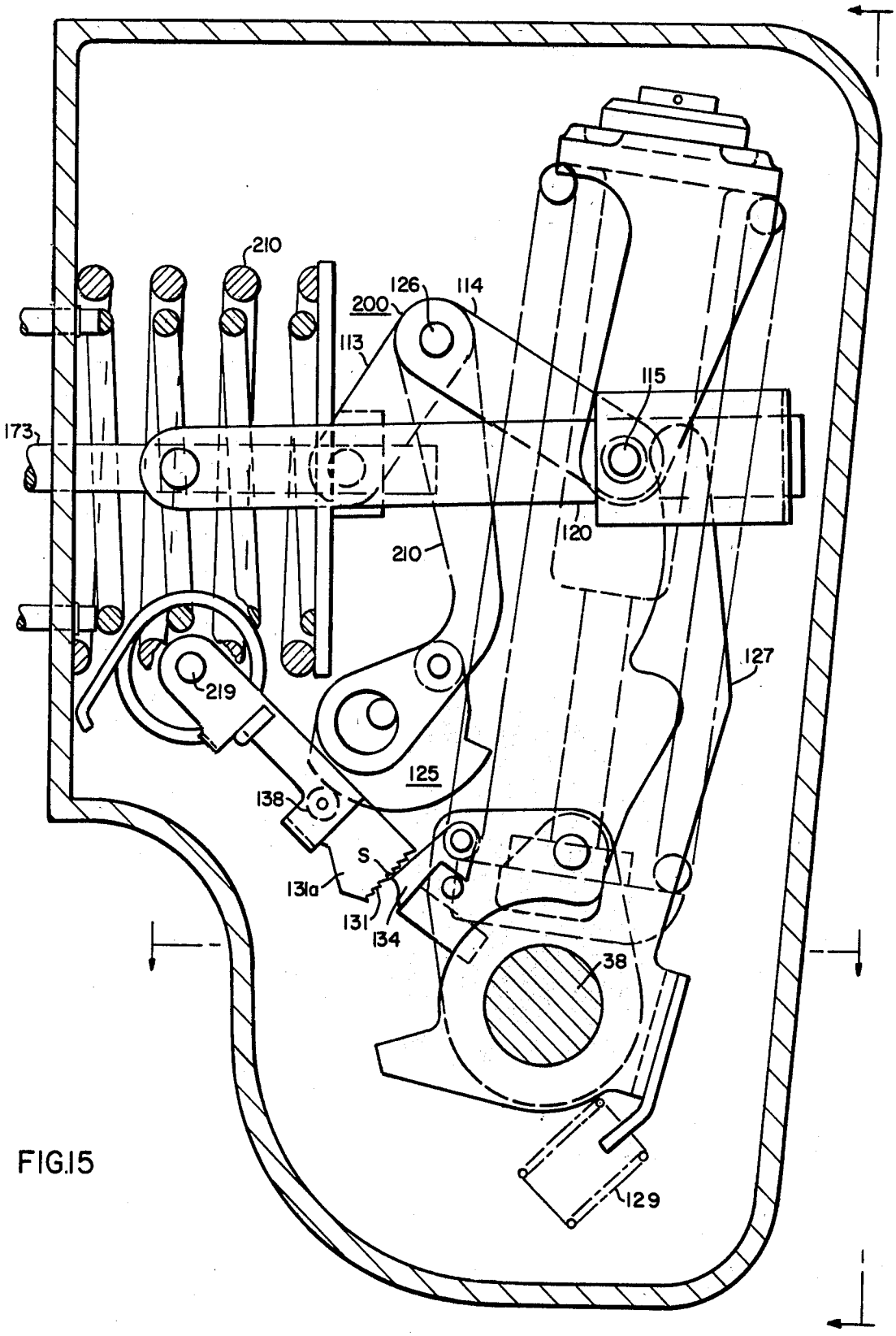
FIG. 15 is a view similar to those of FIGS. 12-14, but illustrating the position of the several mechanism parts of the interrupter in a tripped released condition, with the interrupter contacts open, but the latch linkage parts not being yet reset and the closing spring relaxed.
Figure 16:
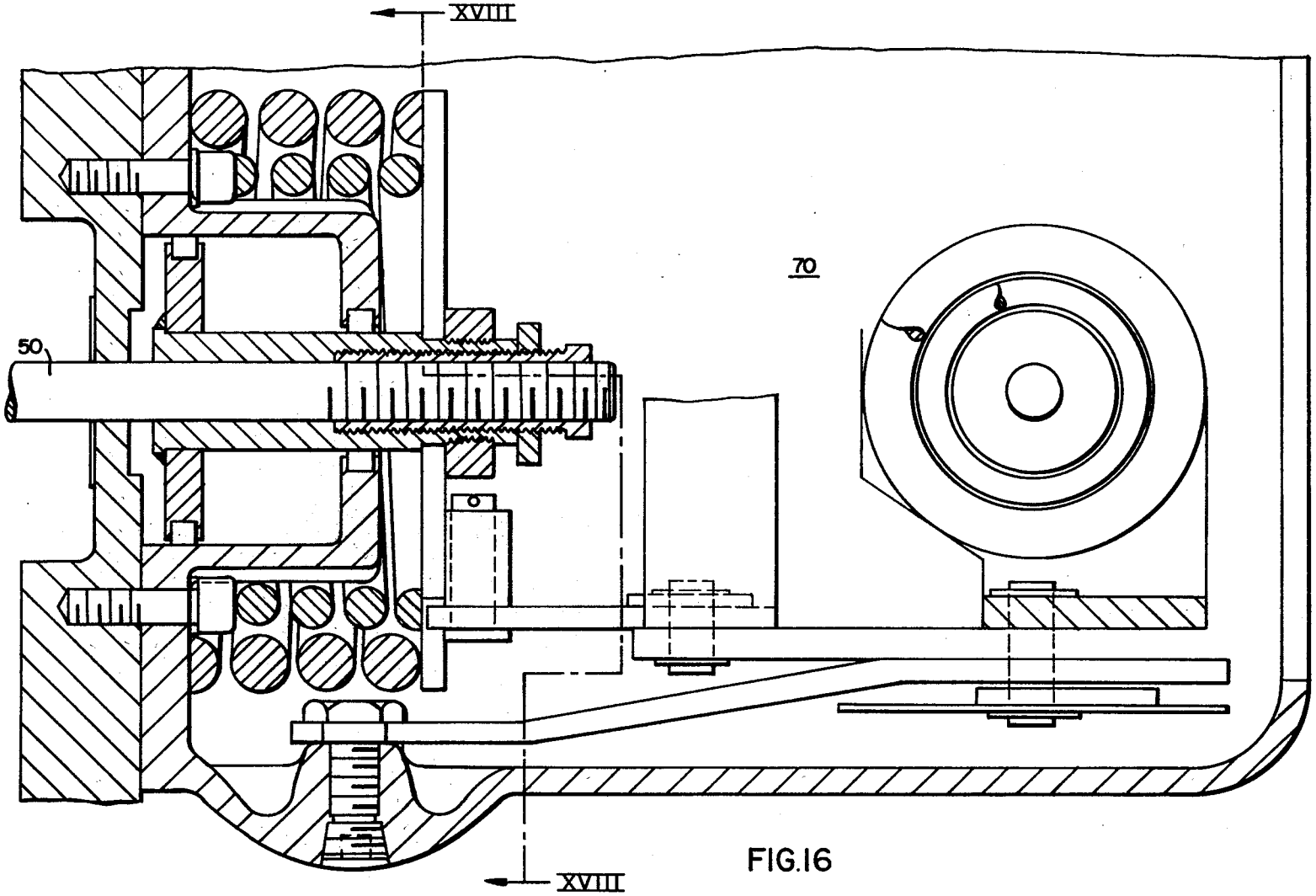
FIG. 16 is an enlarged sectional view taken substantially along the line XVI—XVI of FIG. 18.
Figure 17:
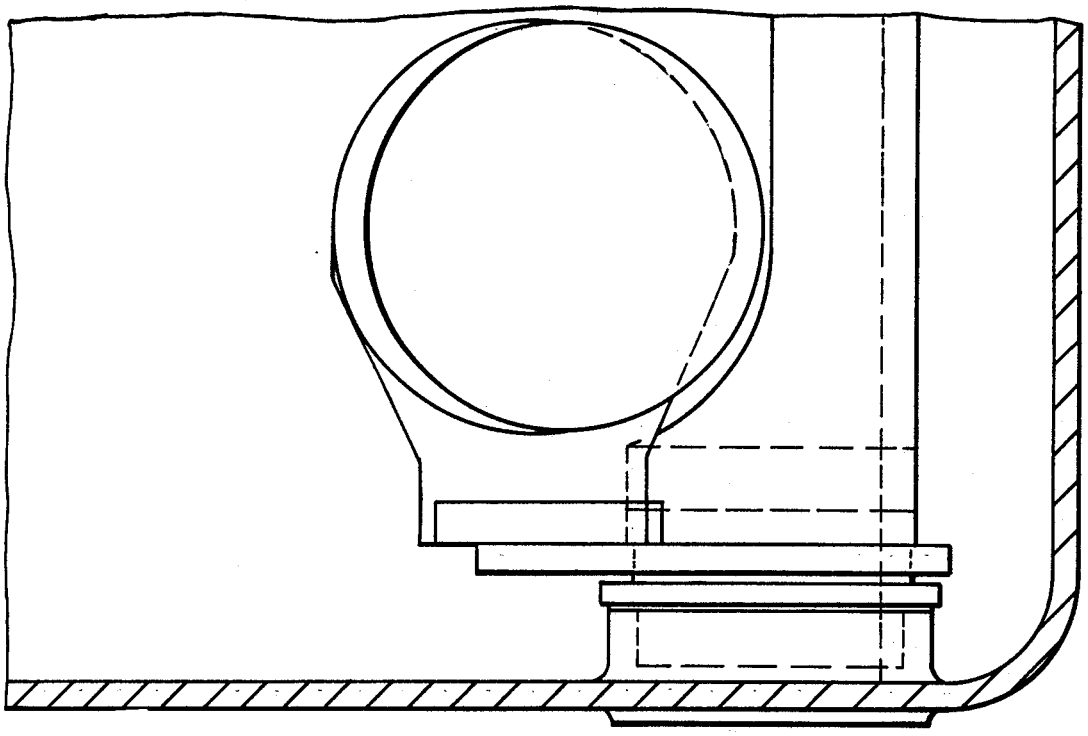
FIG. 17 is a partial fragmentary sectional view taken substantially along the line XVII—XVII of FIG. 12.

With reference to FIG. 16 of the drawings, it will be observed that the mechanism 35 is bolted to the right-hand metallic end-plate 164 of the interrupter 30, as shown more clearly in FIG. 16 of the drainings. The mechanism construction 35 is shown in more detail in FIGS. 12, 13, 14 and 15 of the drawings.

Figure 12:
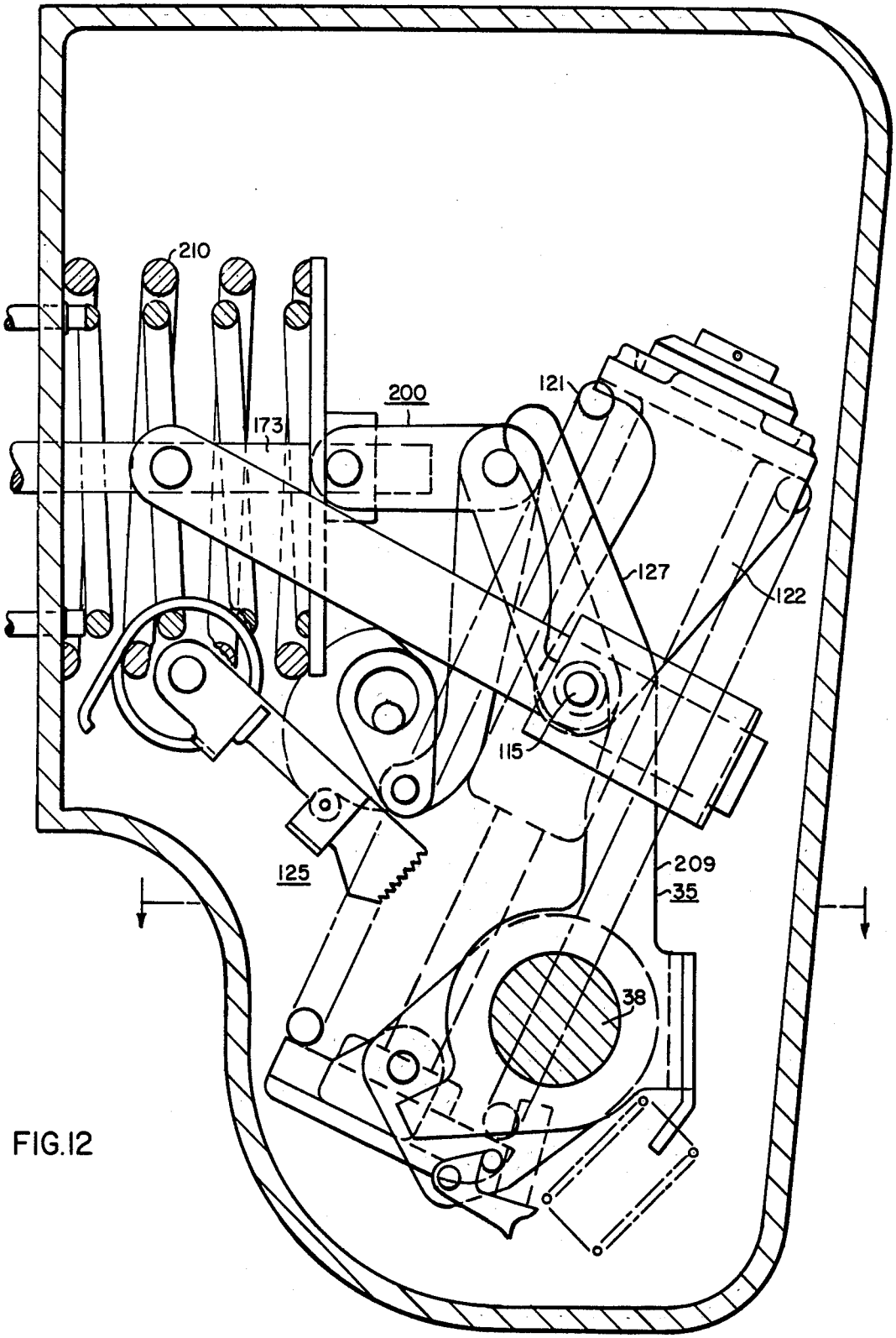
FIG. 12 is an enlarged inverted plan sectional view taken through the operating mechanism for the circuit-interrupter at the upper end of the device at high voltage along the line XII—XII of FIG. 4, the several parts being shown in the fully-open-circuit position of the circuit interrupter assembly, and the latch linkage parts being in the reset condition and ready to begin a closing operation.
Figure 13:
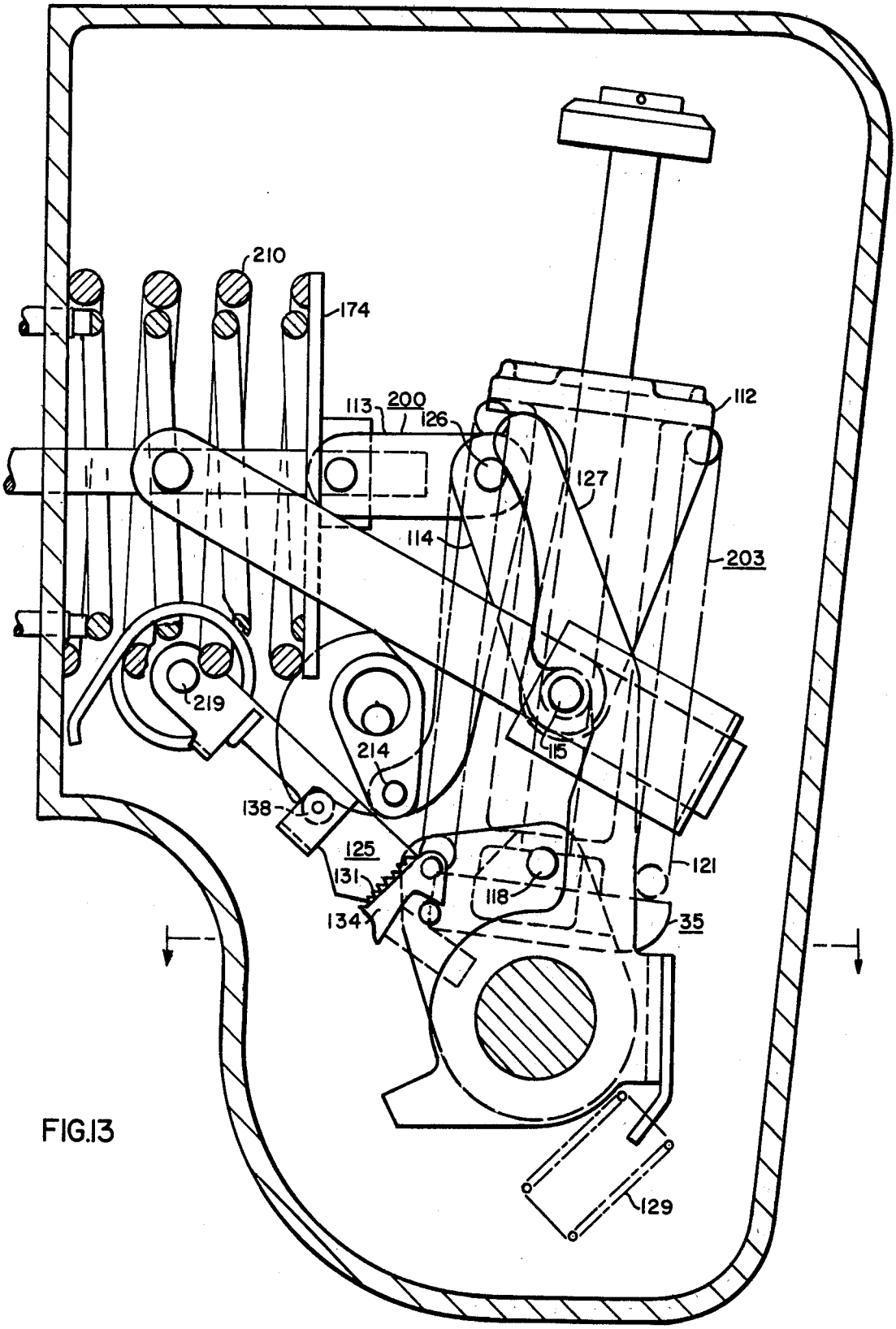
FIG. 13 is a view similar to that of FIG. 12 but illustrating the position of the several mechanism parts at a point in time at which the circuit-interrupter contacts are just about to be closed by release of the closing-spring storage means.
Figure 14:
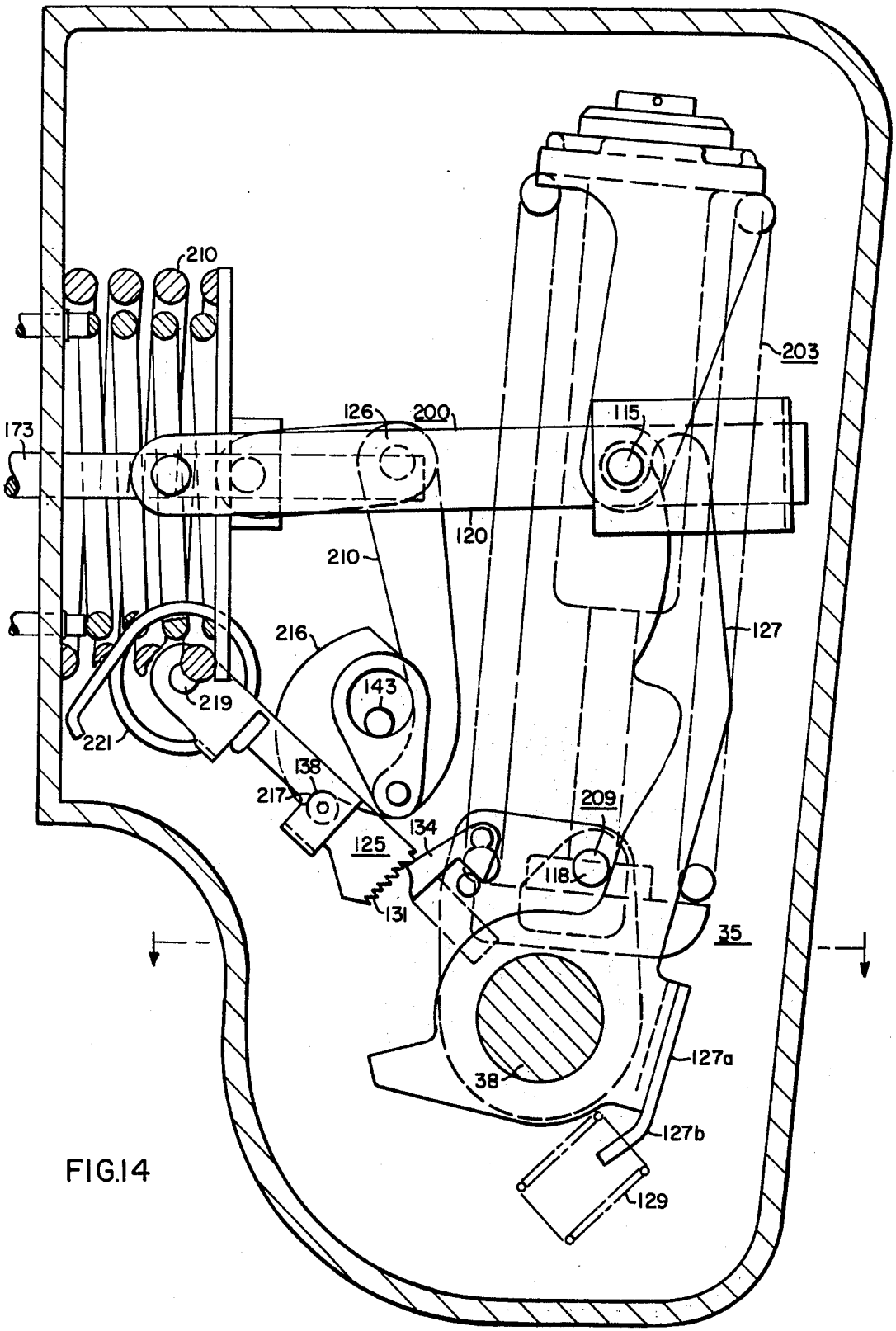
FIG. 14 is a view similar to those of FIGS. 12 and 13, but illustrating the position of the several linkage parts in the closed-circuit position of the entire circuit-interrupter assembly, with the device being ready to trip to the open-circuit position.

FIG. 12 illustrates the operating mechanism 35 for the interrupter 30 in the fully open-circuit position with the linkage parts reset. FIG. 13 illustrates the disposition of the linkage parts of the mechanism 35 in the ready-to-close position. FIG. 14 illustrates the position of the mechanism parts 35 in the closed position of the interrupter 30 and disconnecting switch 2, and ready to trip open upon a very slight counterclockwise rotation of the driving insulator column 4, as more clearly described hereinafter. FIG. 15 illustrates the disposition of the several parts of the mechanism linkage in the tripped position with the interrupter 30 open, the disconnecting switch 2 still remaining closed, and the parts of the first latching mechanism 125 not being reset.

Energy for closing the circuit-interrupter contacts 31 within the interrupter casing 30 is supplied by a pair of nested springs 121, 122 (FIG. 24), which are contained between a pair of yoke members 108 and 112. Yoke member 108 is moved upwardly as the drive shaft 38 is rotated in a clockwise direction with reference being directed to FIG. 12. The operating drive shaft 38 is, of course, secured to the upper end of the rotatable operating driving insulator column 4 of FIG. 4, and is rotated upon rotation of the insulator column 4. The upper yoke 112 carries lateral-disposed trunnions 115, about which the toggle links 113 and 114 are pivoted. The guide link 120 (FIG. 14) rotates about a fixed pivot pin 123 (FIG. 16), which is fixedly anchored to the internal side-walls **34*a* of the mechanism housing 34, which guide links 120 (two in number) restricts the rotative motion of the trunnions 115 to an arc about the fixed pivot pin 123. The toggle link 113, together with an additional interconnecting toggle link 114, are joined at a knee-pin 126 (FIG. 16) to form the collapsible toggle-linkage 200, the collapse of which is restricted by a control link 210, which is also connected to the latch assembly 125 of the first releasing means. The opposite end of the toggle link 113 is connected to the operating shaft 173 of the circuit-interrupter 30 by means of a spring plate 174. This is more clearly shown in FIG. 16** of the drawings.

Figure 23:
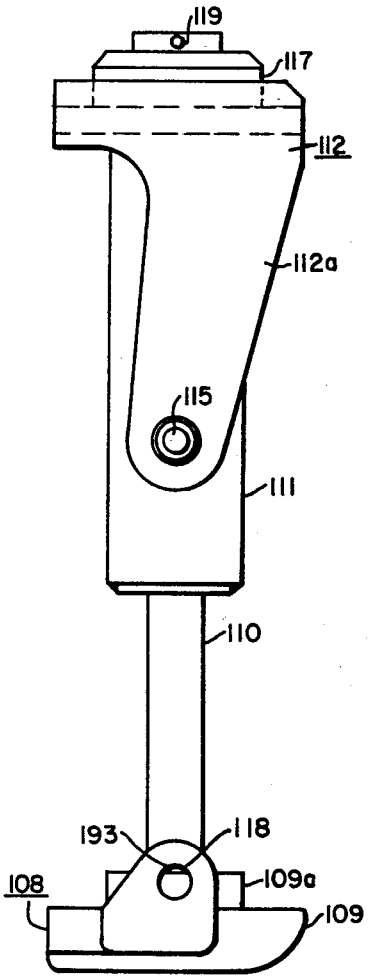
FIG. 23 is a side-elevational view of the closing-spring retainer assembly for the closing-spring energy-storage assemblage.
Figure 24:
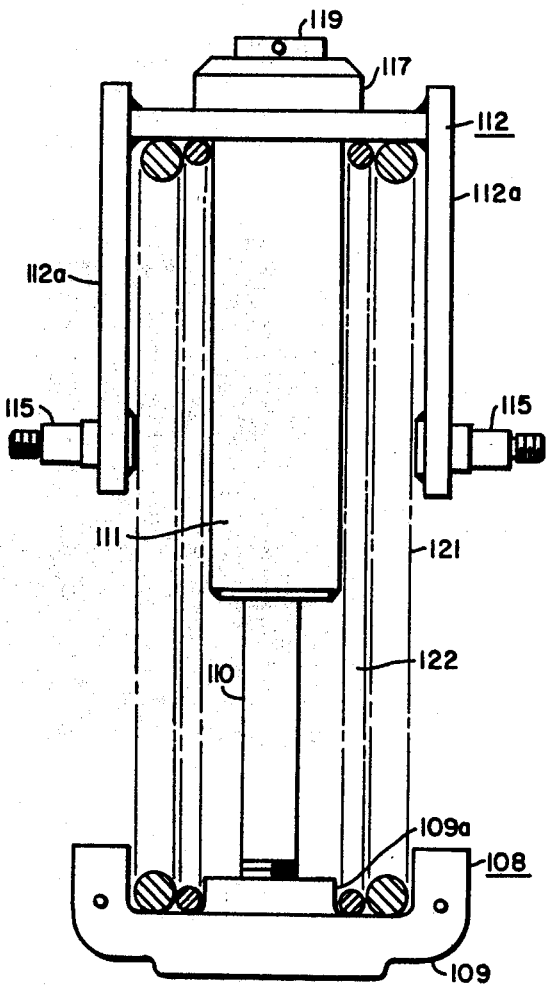
FIG. 24 is a front elevational view of the retainer-spring assemblage of FIG. 23, but illustrating the addition thereto of the closing-spring assemblage supported therein.
Figure 27:
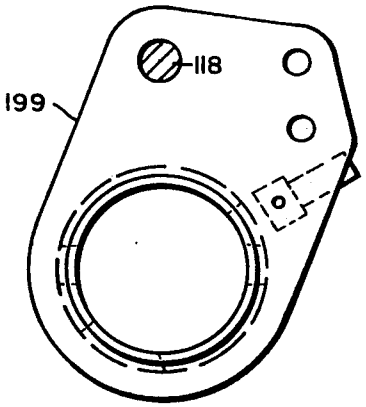
FIG. 27 is an end-elevational view of the other end of the operating-sleeve assemblage of FIG. 25 illustrating the other crank-arm.

With reference being directed specifically to FIGS. 23 and 24 of the drawings, it will be apparent that there is provided a lower spring-seat assembly 108, comprising a cup-shaped spring-plate yoke 109 having an upwardly-extending supporting flange portion 109*a*, which is threadedly secured to a spring guide stud 110, which slidably passes through a spring guide-sleeve 111, the latter being affixed, as by welding, to an upper spring-seat yoke assembly, designated by the reference numeral 112, which has a pair of downwardly-extending leg portions 112*a*. As shown in FIG. 24, the downwardly-extending leg portions 112*a* have lateral-extending pivot, or trunnion pins 115 extending outwardly therefrom, the purpose for which will become more apparent hereinafter. It will be observed moreover that threadedly secured to the top of the guide stud 110 is an adjustable nut 117, which is retained in its adjusted position by a laterally-extending locking pin 119. Thus, in the positions shown in FIGS. 23 and 24, the battery of biasing compression springs 121 and 122 are compressed in their pre-charged state, and are maintained in a pre-charged condition by the guide stud 110 and the upper adjustable nut 117 threaded thereon, which is disposed above and in abutment with the upper U-shaped spring-plate yoke member 112.

A pair of hook-links 127 constituting a part of a second releasing means 209 are pivoted directly upon the drive shaft 38, and are biased in a counterclockwise direction, as viewed in FIG. 14 of the drawings, by a spring 129. In more detail, the two hook-links 127 are connected together by a T-shaped plate 127*a*, having a tongue portion 127*b* biased by the spring 129. These two hook-links 127 cooperate with the lateral trunnions 115 to restrict the releasing motion of the upper yoke member 112, while the closing compression springs 121, 122 are being compressed by the clockwise driving rotation of the operating shaft 38. Toward the end of the clockwise closing travel of the lower yoke 108, release pins 118 moving with the lower yoke member 108, contact the hook-links 127 moving them clockwise and disengaging them from the lateral trunnions 115 permitting thereby the closing springs 121, 122 to thereby expand, straightening the toggle linkage 113, 114 and close the interrupter contacts 31 at high speed within the interrupter casing 32.

Figure 30:
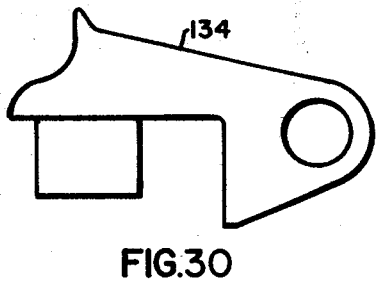
FIG. 30 is a plan view of the pawl for the latch-assembly for releasing the toggle-linkage of the circuit-interrupter.
Figure 29:
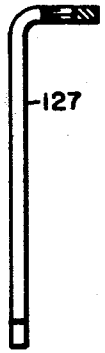
FIG. 29 is an end-elevational view of the holding-lever of FIG. 28.
Figure 35:
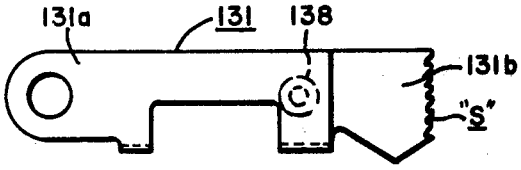
Figure 38:
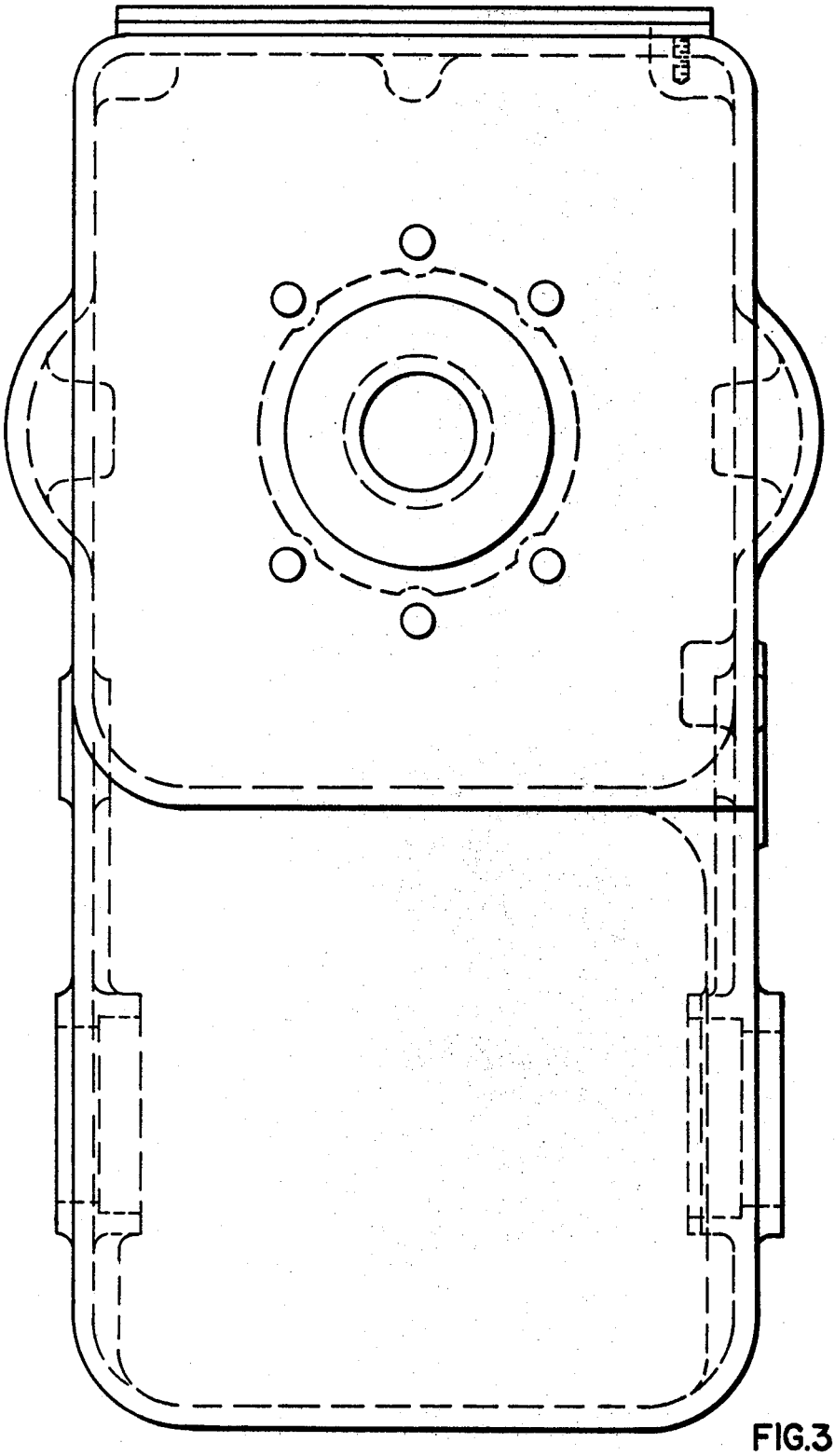
FIG. 38 is an end-elevational view of the mechanism-housing casting.
Figure 39:
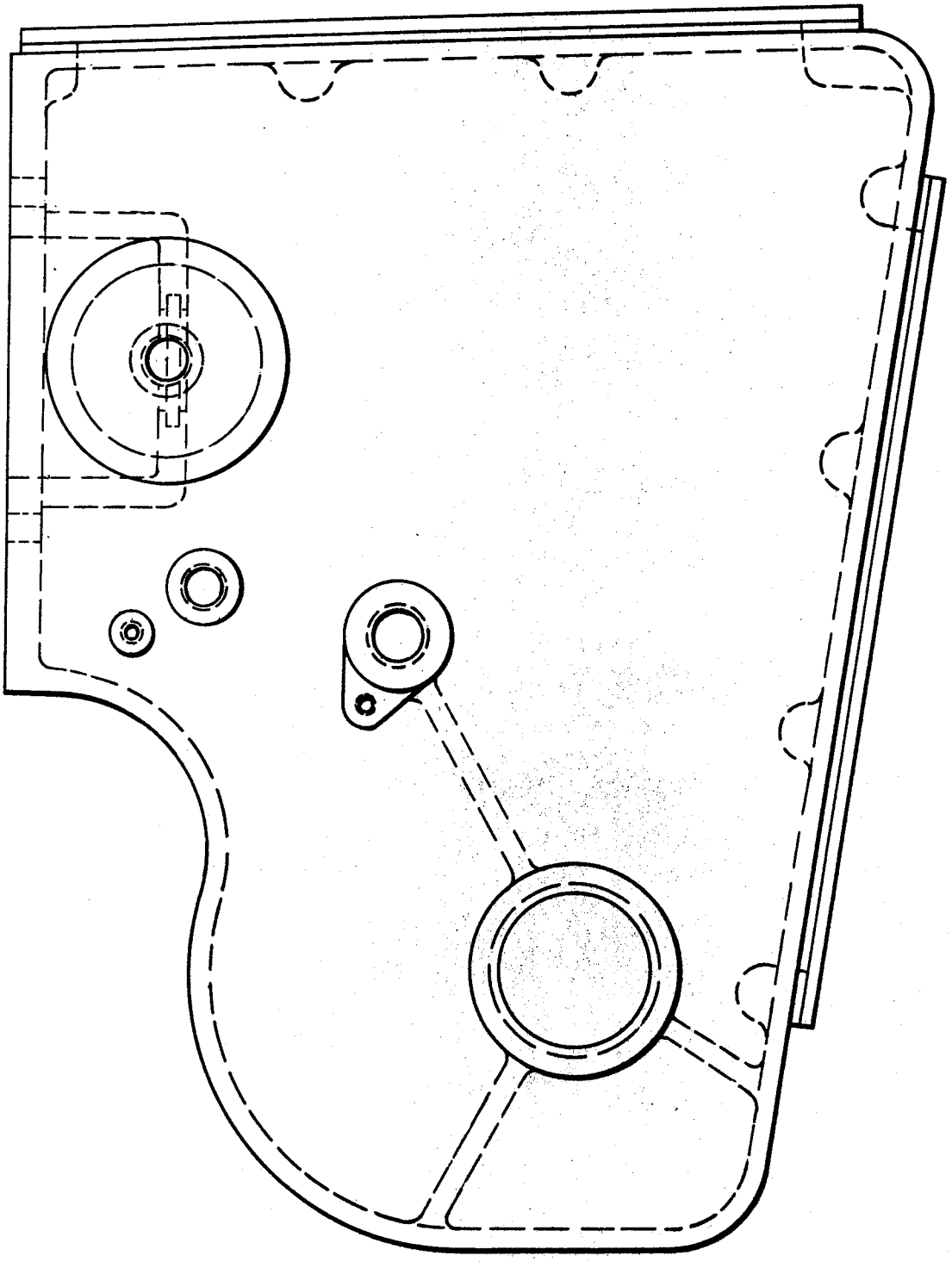
FIG. 39 is a side-elevational view of the mechanism-housing casting of FIG. 38.

It will be observed that in FIG. 14, which shows the interrupter 30 closed, that a trip pawl 134 (FIG. 30) moves on a crankplate 199 with the drive shaft 38, and that this release pawl 134 is in contact with a ratchet 131 carried by a trip-trigger assembly 131 (FIG. 35).

In more detail, with reference to FIGS. 15, 19, 35, and 36, which more clearly show in detail the rotatable tripping latch 131, it will be noted that, generally, there is provided a stamped U-shaped channel member 131 having side leg portions 131*a* and 131*b*, one of the leg portions 131*b* having an end portion with a serrated end surface "S," as shown more clearly in FIG. 35 of the drawings.

As more fully described hereinafter, the serrated latching surface "S," when reversed by reverse counterclockwise rotation of the tripping pawl 134, will effect release of a roller 138 (FIG. 15) from the position illustrated in FIGS. 13 and 14, to the released position, as illustrated in the tripped position of the interrupting unit 30, as shown in FIG. 15 of the drawings. As previously described, the off-center tripping shaft assembly 143 is more clearly illustrated in FIGS. 6, 14, 31, and 32 of the drawings. This assembly, as shown in more detail in FIGS. 31 and 32, has end mounting pivot pins 145 and 146, which fit into upper and lower bearing holes 104, 105 (FIG. 6) provided in the top and bottom sidewall plate portions 34*b* of the mechanism-housing casting 34.

A very small counterclockwise rotation of the operating drive shaft 38 will, accordingly, release the latch roller 138 of the first releasing means, permitting thereby the toggle-linkage 200 to fold, or collapse, and the interrupter contacts 31 to be driven open by the opening accelerating springs 210, again at high speed. During this time, of course, the disconnecting switch contacts 8, 11 are closed, so that there is no arcing whatsoever occurring at the disconnecting switch contacts 8, 11 (FIG. 4). Additional counterclockwise opening rotative movement of the operator drive shaft 38 resets the links 113, 114 to the position, as shown more clearly in FIG. 13 and effects opening swinging motion of the disconnecting switchblade 8 to position 37 of FIG. 4.

As mentioned, it will be observed that the improved interrupter operating mechanism 35 of the present invention includes a latched laterally-movable collapsible toggle-linkage, generally designated by the reference numeral 200, which is laterally movable to the left, as viewed in FIG. 12, to effect the closing of the contact structure 31 within the interrupting unit 30. In more detail, the operating rod 173 extends through the aperture 167 in the end-plate portion 164 of the mechanism housing 34, as illustrated more clearly in FIG. 16 of the drawings. This operating rod 173 is extended through a hollow piston rod 180, the left-hand end of which is fixedly secured, as by welding, for example, to a movable piston 182 movable within the dashpot strcture 184 to cushion the end of the opening operation of the contacts 31. It will be noted that the dashpot structure 184 is formed as an integral part of the mechanism-housing end-plate 34*c*, as is illustrated more clearly in FIG. 16 of the drawings. The piston structure 182 has the hollow stem portion 180 thereof, movable through a sealed opening 172, and is secured to the spring-plate 174 by a nut 176, which is threaded onto the outer threads 178 of the hollow piston stem 180. Interposed between the inner side wall 34*c* of the mechanism housing 34 and the movable spring-plate 174 is a battery of opening accelerating compression springs 210, in this particular instance comprising two in number. As shown in FIG. 16 these opening accelerating compression springs 210 seat at their left-hand ends against the inner wall 34*c* of the mechanism housing 34, and at their right-hand ends against the movable spring-plate 174. In addition, the spring-plate 174 has a pair of journals 168, forming pivot-bearing openings, welded to the right-hand side of the movable spring-plate 174. The bearing openings 168 provided bearings for the pair of movable toggle-links 113, which are pivotally connected to the two knee-pins 126 to a second set of toggle-links 114, the right-hand ends of which are pivotally secured at 115 to the downwardly-extending legs 112*a* of an upper spring-support yoke plate 112, constituting a part of the closing-energy storage structure, the latter being generally designated by the reference numeral 203.

Figure 32:
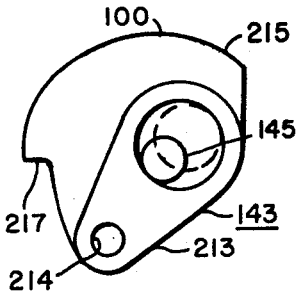
FIG. 32 is an end-elevational view of the off-center tripping rod assembly for releasing the toggle-linkage of the interrupter mechanism.
Figure 31:
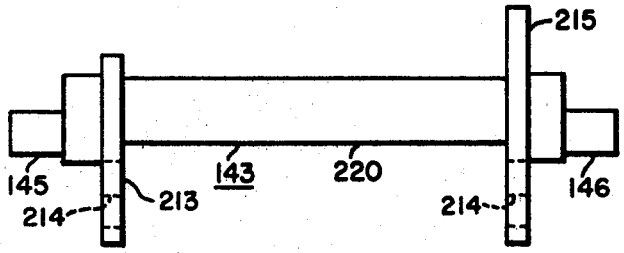
FIG. 31, is a side-elevational view of the off-center tripping rod assembly of FIG. 49.
Figure 33:
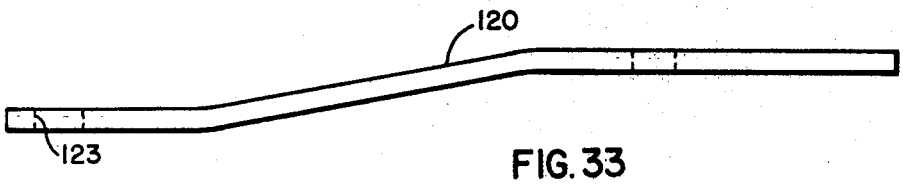
FIGS. 33 and 34 are side-elevational and top-plan views of the guide-link utilized in the improved mechanism.
Figure 34:
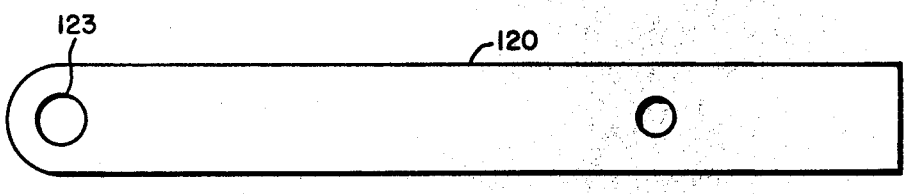
Figure 36:
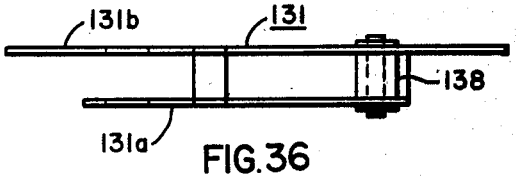
FIGS. 35 and 36 are, respectively, side-elevational and top-plan views of the serrated rotatable latch-assembly utilized in the improved mechanism of the present invention.
Figure 37:
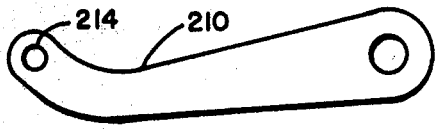
FIG. 37 is a side-elevational view of one of the control-links utilized for latching the releasable toggle mechanism of the present invention.

FIG. 14 illustrates the longitudinally-movable toggle-linkage 200 in its latched underset condition, the knee-pins 126 being maintained in their straightened condition by the downwardly extending movable control latch-levers 210, the latter being pivotally connected, as at 214, to latching toggle plate members 100, 215 of an offcenter trip-shaft assembly 143 (FIGS. 31, 32). This assembly has an offset portion 217, which is normally maintained in latching engagement by the roller 138 (FIG. 13). The roller 138 is pivotally supported between the side-arms 131*a*, 131*b* of the pivotally-mounted latch 131, as illustrated more clearly in FIGS. 35 and 36 of the drawings. As shown in FIGS. 13 and 14, normaly the latch roller 138 latches into the underset portion 237 of the cam plate 215, and maintains the collapsible toggle structure 200 in its straightened underset condition as shown in FIG. 14.

Figure 21:
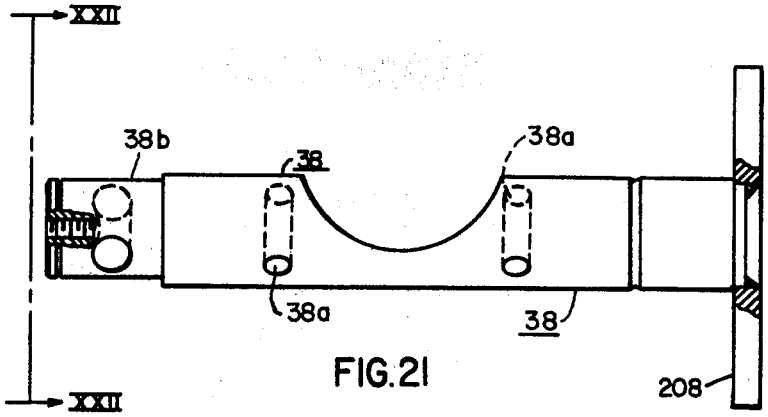
FIG. 21 is a side-elevational view of the vertically-disposed operating-shaft assembly for the mechanism for operating the circuit-interrupter contacts.
Figure 25:
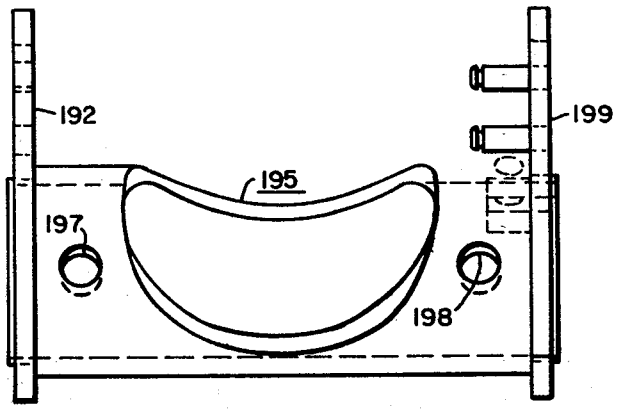
FIG. 25 illustrates a side-elevational view of the operating-lever crank-arm sleeve-assemblage, which encompasses the operating-shaft assembly of FIG. 21, illustrating the end operating levers or operating cranks therefor.
Figure 26:
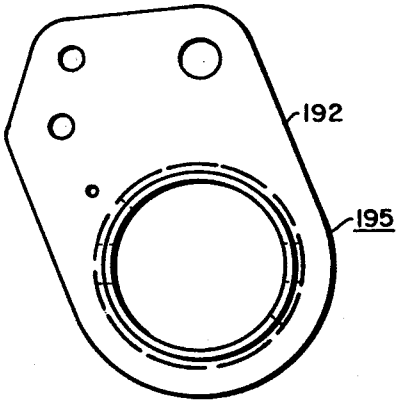
FIG. 26 is an end-elevational view of the operating-sleeve assemblage of FIG. 25 illustrating one crank-arm.

An important feature of the present invention is the utilization of the energy-storage device 203 to effect a leftward closing quick movement of the contact operating rod 173 against the opening spring pressure afforded by the battery of opening accelerating compression springs 211, 212. As mentioned hereinbefore, the opening springs 211, 212 are, of course, weaker than the closing-spring assemblage 121, 122. This opening biasing movement is achieved and obtained by the rotative closing movement of the operating post insulator 4. In more detail, the upper end of the post insulator 4 has secured thereto the flange 208 (FIGS. 6 and 21) of the driveshaft 38 to which is keyed by pins 38*a* the crank-arm sleeve 195 (FIG. 25).

Figure 7:
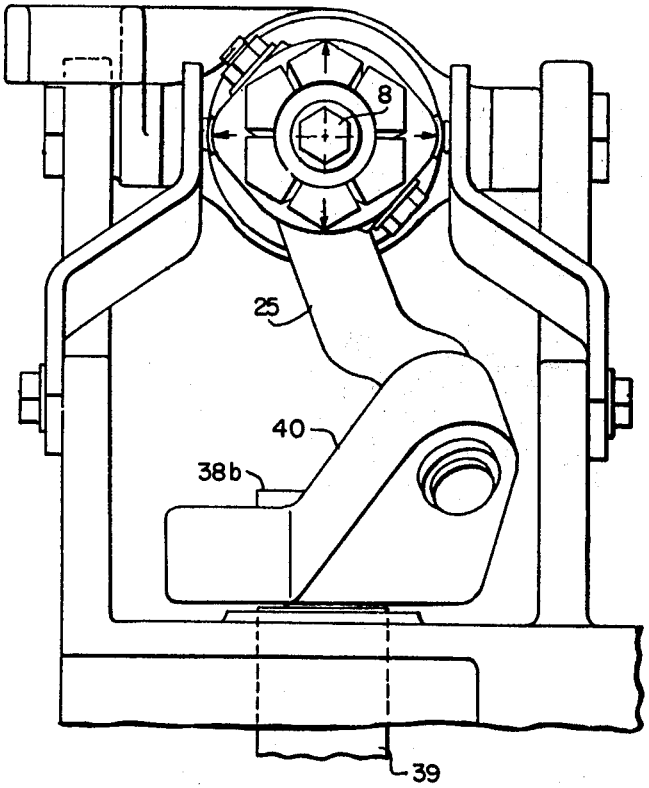
FIG. 7 is a fragmentary enlarged end-elevational view of the crank-arm for operating the hinge-end of the disconnecting-switch assembly, the several parts being illustrated in the switch-closed position.
Figure 40:
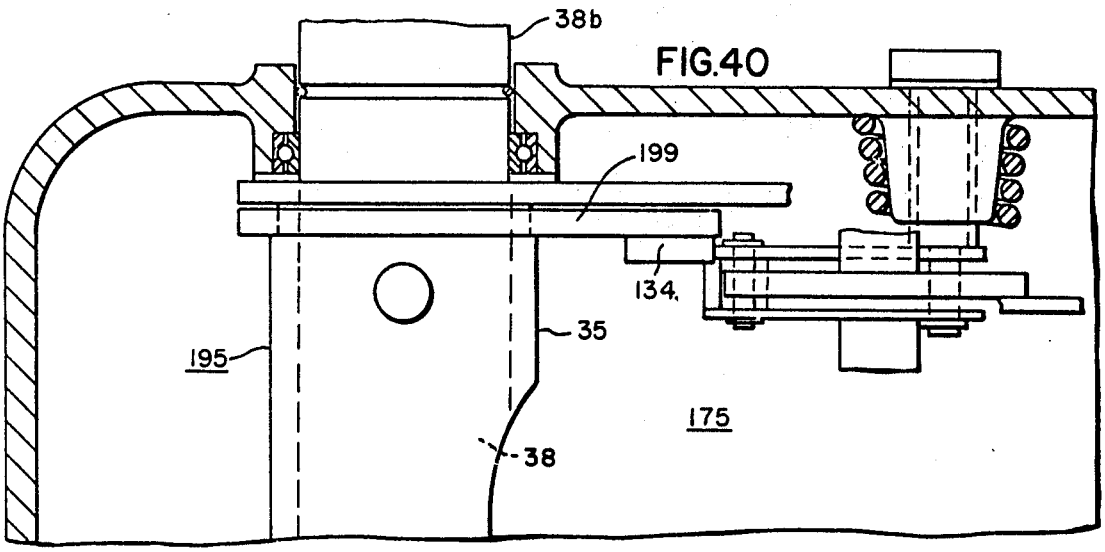
FIG. 40 is a fragmentary vertical sectional view taken substantially along the line XL—XL of FIG. 13.

The drive shaft 38 has an extension 38*b* (FIGS. 7 and 40) to which is affixed a crank-arm 40 (FIG. 7) which is rotatable during both the opening and closing operations of the disconnecting-switch device 2 of the present invention.

In more detail, the upwardly-extending operating shaft 38 has the sleeves 195 (FIGS. 6 and 40) pinned thereto, as by key pins 38*a*. The sleeve 195 (FIG. 25) is, consequently, rotatable with and movable with the operating drive shaft 38. In addition, the sleeve 195 carries a pair of spaced operating crank arms 192 and 199, which are pivotally connected, as at 118, to the lower spring-support yoke member 108, which cooperates with the aforesaid upper spring-support yoke member 112 to house the battery of energy-storage closing-springs 121, 122, which are charged during the closing operation of the disconnecting switch 2 of the present invention in a manner more fully described hereinafter.

It will be observed that there is provided a vertically-spaced pair of guide links 120 (FIG. 16), which are pivoted about the stationary pivot supports 123 disposed at the upper and lower sides of the mechanism housing 34. FIG. 16 more clearly shows the stationary pivot-supports 123 on the inner side walls 34*a* of the mechanism housing 34 provided for the fixed rotative motion of the two guide-links 120. Accordingly, the two guide links 120 restrict the arcuate travel of the trunnion pivot-pins 115 to an arc about the center of the stationary pivot-points 123. Also pivoted about the knee-pins 126 are the cooperable pair of latching toggle-links 210, which have slightly elongated holes at their lower ends. Cooperating with these holes are pins 214 provided in the arms 213, 215. The arms 213, 215 are welded to the shaft 220, which is journaled in the upper and lower bearings 104, 105 (FIG. 6). One of the arms 215 has a stepped cam surface 217 formed integrally therewith, as shown more clearly in FIG. 32.

Figure 18:
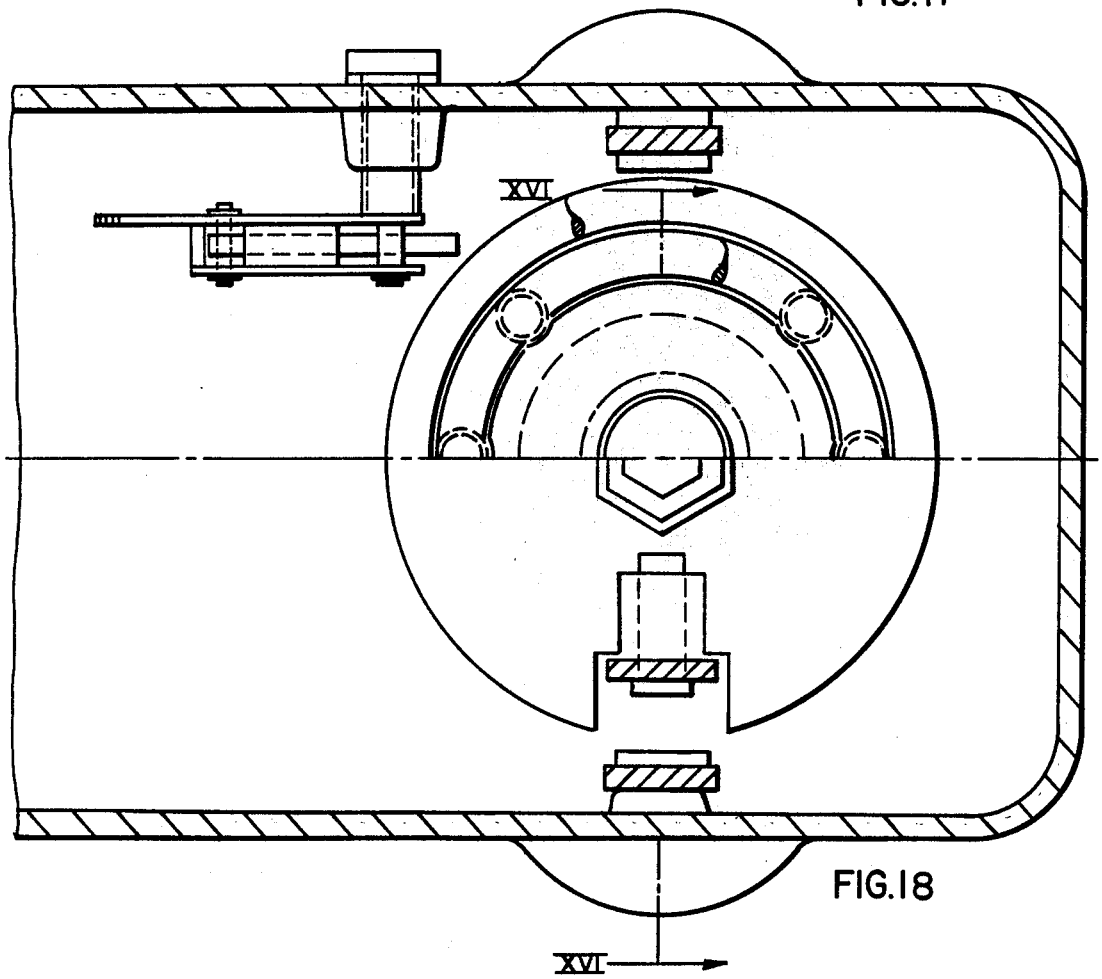
FIG. 18 is a broken fragmentary sectional view taken substantially along the line XVIII—XVIII of FIG. 16.
Figure 19:
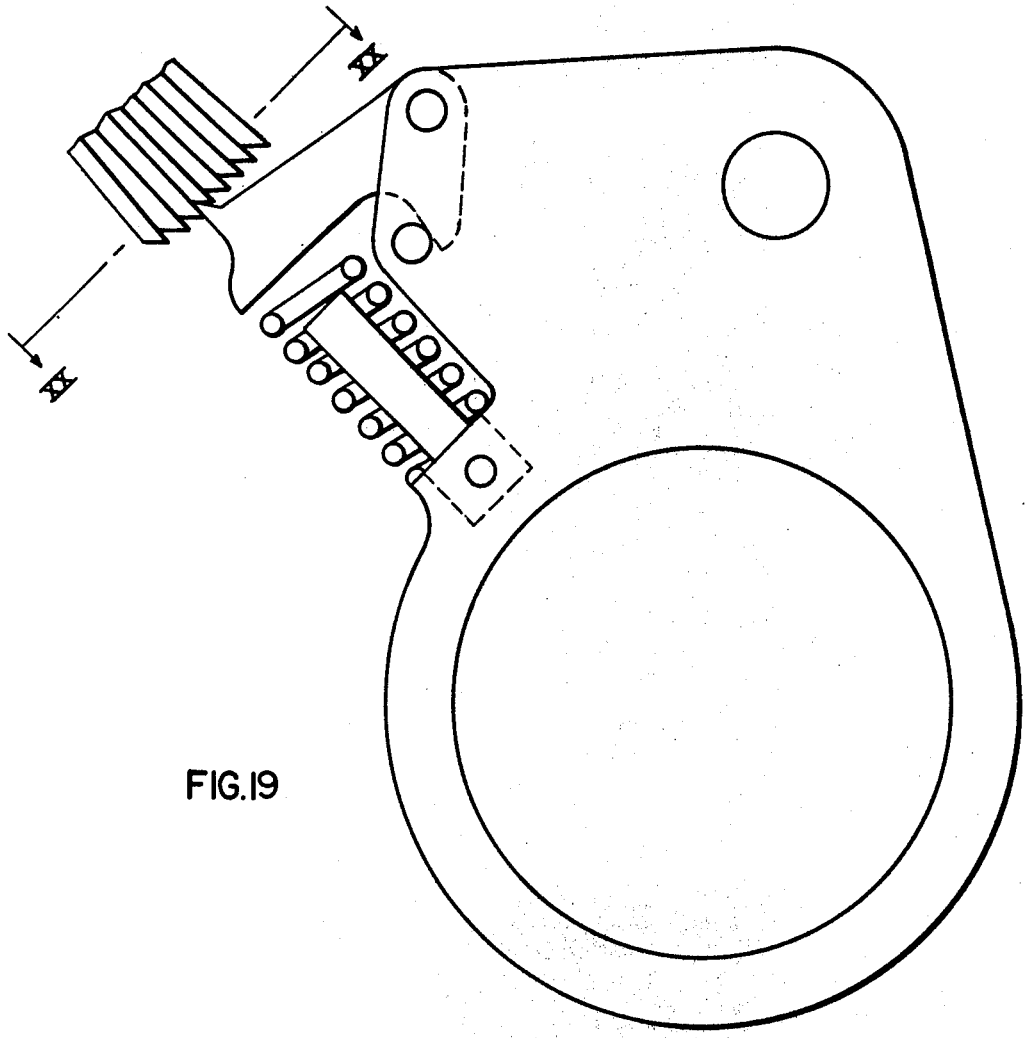
FIG. 19 is a considerably-enlarged top-plan view of the rotatable tripping pawl affixed to, and rotatable with the crank-arm of the driving shaft assembly showing the interengagement between the nose of the rotatable tripping pawl and the ratchet surface of the rotatable latch assembly of the improved circuit-interrupter mechanism taken substantially along the line XIX—XIX of FIG. 18.
Figure 20:
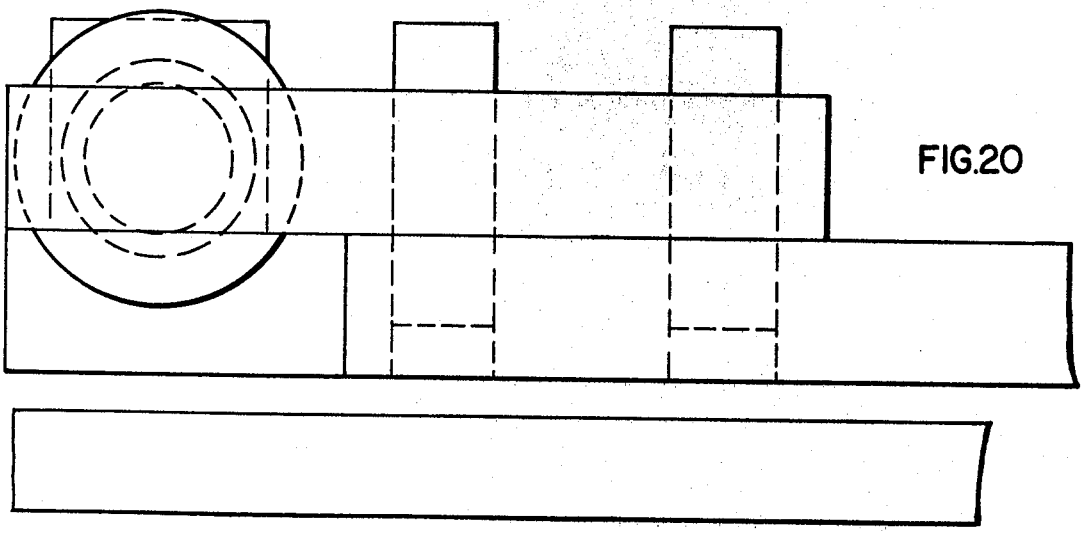
FIG. 20 is an enlarged fragmentary top-plan view of the tripping pawl assembly, illustrated in FIG. 19, taken substantially along the line XX—XX of FIG. 19.
Figure 22:
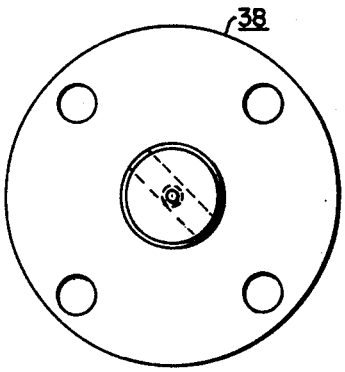
FIG. 22 is an end elevational view of the operating-shaft assembly of FIG. 21.

The tripping trigger assembly 131 is biased in a counterclockwise direction by a spring 221 (FIG. 14) against the latch notch 217. The latch 131 is pivoted around a pin 219 (FIG. 14), which is held by the mechanism housing side wall 34*d* (FIG. 18). This latch carries the roller 138 which cooperates with the step 217 provided in the latch-cam 215. The serrated edge "S" of the latch 131 cooperates with the trip pawl 134 which is attached to one of the crank-arms 199. The hook members 127 are pivoted around the drive shaft 38 and are biased in a counterclockwise direction by spring 129, as more clearly illustrated in FIG. 15.

CLOSING OPERATION OF THE INTERRUPTER MECHANISM 35

Figure 28:
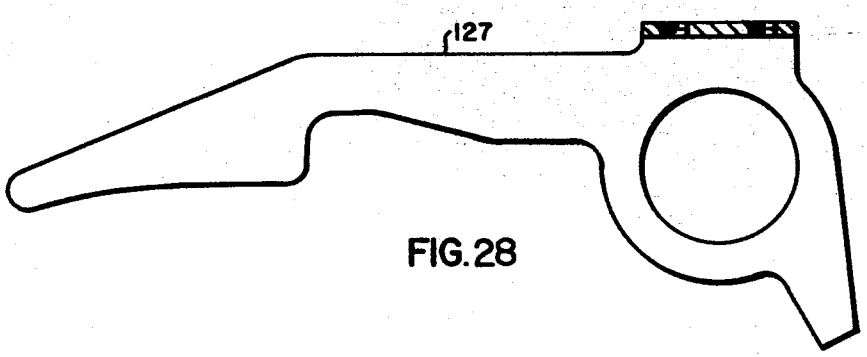
FIG. 28 is a detailed view of the holding-lever utilized in the operating mechanism for operating the circuit-interrupter.

FIG. 12 shows the interrupter operating mechanism 35 with the disconnecting switch contacts 8, 11 and the interrupter contacts 31 both open. The closing operation is performed by rotating the vertically-disposed operating shaft 38 in a clockwise direction, as viewed in FIG. 12. The two latch hooks 127 (FIG. 28) cooperate with the pins 115 to retain the latched position of the upper spring-seat yoke 112 while the two crank-arms 192, 199 rotate clockwise to drive the lower U-shaped spring-seat yoke-member 108 upwardly to compress the battery of closing compression springs 121 and 122. Approximately 10° before the final position of the operating drive shaft 38, the release pins 118 moving with lower yoke member 108 rotate the latching hooks 127 in a clockwise direction against their spring bias, which releases or frees the pins 115 and permits the closing springs 121, 122 to expand upwardly, and force the pins 115 to rotate in an arc about the fixed pivot pins 123. This applies a compressive closing force to the toggle-links 113, 114, but the pins 115 are restricted in their arcuate motion by the guide-links 120 to an arc about the fixed pins 123. Consequently, the motion of the knee-pins 126 is mostly in a leftward horizontal closing direction, and thus knee pin 126 drives the toggle-link 113, 114 horizontally to the left, as viewed in FIGS. 12–14, to thereby compress the opening accelerating springs 211, 212, and also move the contact operating rod 173 to the left, which closes the separable contacts 150, 151 within the interrupting-unit 30.

Figure 8:
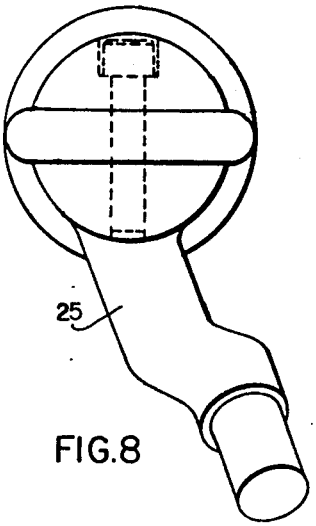
FIG. 8 is an end elevational view of the crank-arm for operating the disconnecting-switchblade.
Figure 9:
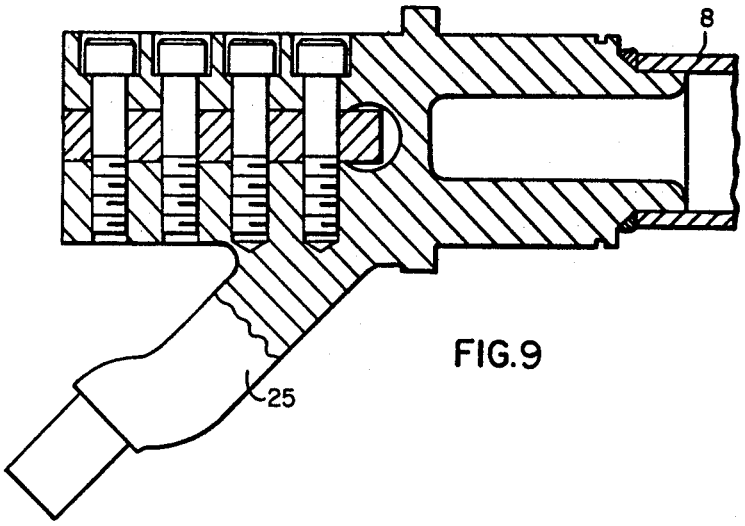
FIG. 9 is a partial fragmentary vertical-sectional view taken through a portion of the crank-arm on the line IX—IX of FIG. 9, for operating the swinging movable disconnecting switchblade.

Rotation of the operating drive shaft 38 to close the interrupter 30 has also rotated the upper crank hinge-arm 40 to thereby rotate the crank-sleeve 25 (FIGS. 7, 8 and 9) and close the disconnecting switch 2. The disconnecting switchblade 8 is closed before the latch hook-members 127 are released to thereby close the interrupter contacts 150, 151 within the interrupter-unit 30. The position of the operating mechanism 35 with both the disconnecting switch-contacts 8, 11 and the interrupter contacts 31 closed is illustrated in FIG. 14.

It will be observed that during the latter part of the closing operation, the trip pawl 134 moving with crank-arm 199 has ratcheted along the serrated edge "S" of the latch release member 131. Consequently, a very small tripping rotation travel of the operating drive shaft 38 in a counterclockwise direction as viewed in FIG. 14 will impart a clockwise rotation to the latch 131 about stationary pivot pin 219. The cam member 215 is biased in a counterclockwise direction by the accelerating springs 210 working against the toggle 200 between the toggle links 113 and 114. When the latch-roller 138 moves out of latching contact with the step 217 provided in the latch cam 215, the arms 213, 215 rotate in a counterclockwise direction as viewed in FIG. 31 permitting the toggle 200 between links 113 and 114 to collapse. Accelerating opening springs 211, 212 expand, which pulls the contact operating rod 173 of the interrupter 30 to the right, and opens the contacts 150, 151 within the interrupter-unit 30. This motion is arrested at the end of the opening stroke by the dashpot piston 182, which operates within the dashpot cylinder 184, which is a part of the mechanism housing 34c. Operating of the interrupter 30 is thus accomplished with a very small rotation of the operating drive shaft 38.

The lost-motion coupling between the operating drive shaft 38 and the disconnecting switch-crank operator 40 permits this rotation before starting to open the disconnecting switch 2. This feature thus reduces the tripping time as well as applies a sharp impact to the initial disconnecting switch opening, which is, of course advantageous if the switch contacts 8, 11 are coated with ice. Also the ratcheting feature "S" of the latch assembly 31 removes the criticality of adjustment of the switch-closed position.

With the operating mechanism 35 in the position illustrated in FIG. 15, further counterclockwise rotation of the operating shaft 38 opens the disconnecting switch 2, and restores the operating mechanisn 35 to reset position illustrated in FIG. 13. Power for the switch operation is derived from rotation of the driving insulator column 4 (FIG. 4), which is rotated by the motor-powered operator 9.

It will be observed that power for both opening and closing the circuit interrupter contacts is derived from the closing operation of the disconnecting switch 2. This is advantageous inasmuch as such switches 2 are often required to open when encased in a layer of ice during winter operation. This scheme of operation leaves all of the energy of the operator 9 free for ice breaking duty during opening of the switch 2, and stores energy for interrupter contact opening operation during switch-closing action when the switchblade 8 is moving relatively freely through the air.

It should also be observed that the sequence accomplished by this interrupter operating mechanism 35 confine all arcing on both opening end closing operations to the inside of the interrupter casing 32, and since the device is able to make currents of full-fault magnitude, this represents a real improvement over any device now on the market with the exception of the costly power circuit-breaker.

Improved first releasing means 125 for effecting a tripping operation of the device is provided including the latching means 131, 143, which will be operated upon any slight counterclockwise rotative opening movement of the operating drive shaft 38 for the switch. In addition, unique adjusting means are provided with power for both opening and closing circuit-interrupter operations being derived from the closing operation of the disconnecting switch 2.

It will be noted that the disconnecting switch 1 has three insulators 3, 4 and 5 the center one of which 4 can be rotated by a conventional ground-level operator 9 linked to the crank-arm 7 at the base of the insulator 4. At the top of the insulator 4 is the mechanism 35 which operates the switch 2 and the interrupter 30. With the switch 2 and the interrupter 30 in the open position, rotation of the insulator column 4 closes the disconnecting switch 2, and charges the interrupter closing springs 121, 122. After the disconnecting switch 2 is firmly closed, the last increment of insulator column 4 rotation releases the closing springs 121, 122 within the operating mechanism 35 to close the interrupter contacts 31 to make the circuit. Rotation of the insulator column 4 a few degrees in the opposite direction, releases the latch 131 which permits the opening springs 211, 212 (which were charged during the closing operation) to drive the interrupter contacts 31 open at high speed, even before the disconnecting switch contacts 8, 11 have been disengaged.

Illustrated at the bottom of the center rotating driving insulator column 4 is a shunt-trip device, or an opening accelerating tripping device 42 (FIG. 41) set forth more in detail in U.S. Patent Application filed May 8, 1974, Ser. No. 468,332 by Stanislaw Milianowicz and Russel E. Frink. This shunt-trip unit or tripping accelerator device 42 is operational, and may be included or omitted, as desired by the utility customer.

TYPICAL RATINGS OF INTERRUPTING DEVICES

Figure 41:
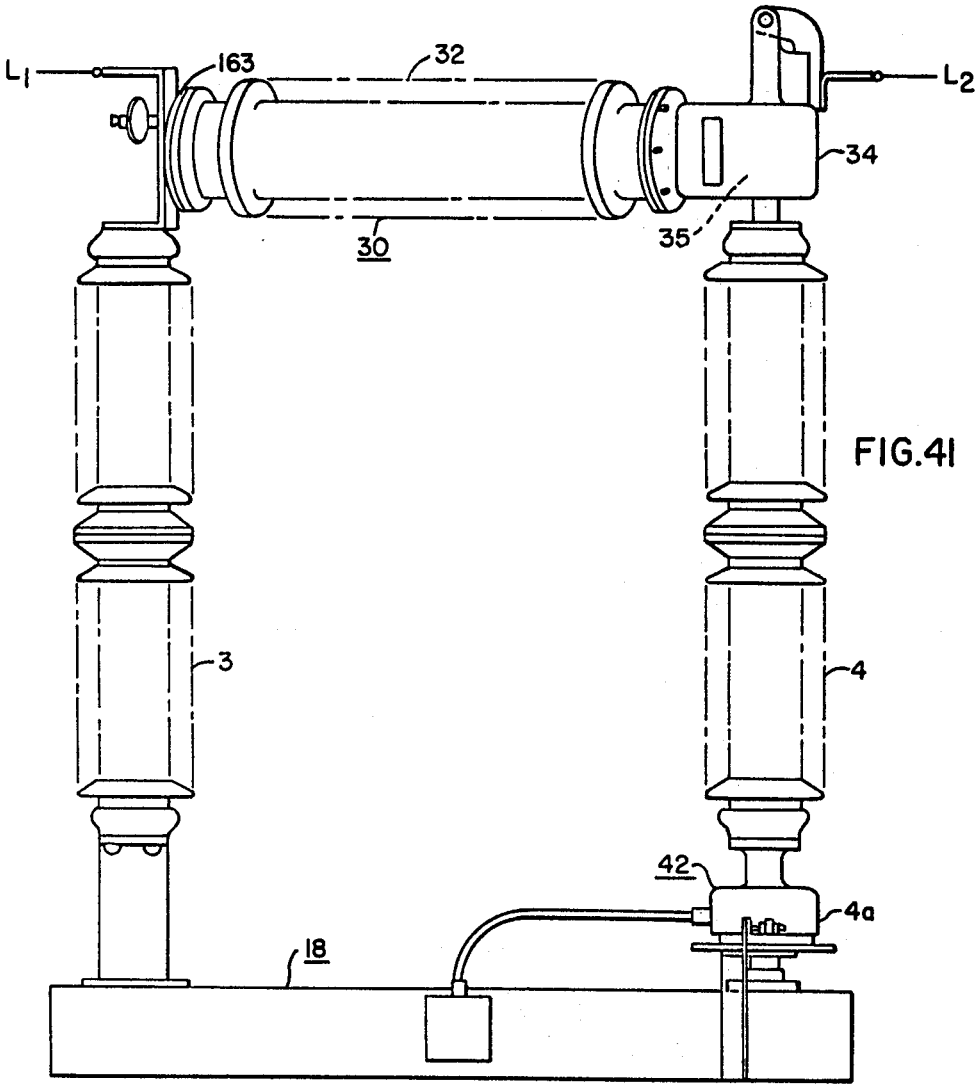
FIG. 41 is an alternate embodiment of the invention wherein a disconnecting switchblade is not used in series with a circuit interrupter, but nevertheless, the advantageous features of the improved operating mechanism as illustrated hereinbefore may be used.

The ratings of interrupting devices 1 incorporating the improved inventions of the present application are as follows:

Rated maximum voltages: 121, 145 and 169 kV
Rated continuous current: 1200 A.
Rated symmetrical interrupting current: 10,000 A.
Rated TRV capability at max. int. current: 1.7 kV per $\mu$S
Momentary current, rms asymmetrical: 61,000 A.
4-second current, rms symmetrical: 40,000 A.
Closing current, rms assymmetrical: 30,000 A.
Interrupting time (60Hz basis): 5 Cycles
Contact opening speed 15.5 ft. per. sec.: (4.7 m per sec.)
Contact closing speed 14 ft. per sec.: (4.3 m per sec.)
Total operating time (open or close): 4 sec.
Control voltages: 48V. dc, 125V. dc and 250V. dc FIG. 41 illustrates an application of the improved operating mechanism 35 for the circuit-interrupting unit 30 in the absence of a disconnecting-switch structure 2. It is to be noted that line terminals $L_1$, $L_2$ are provided at the left-hand end metallic plate 163 of the interrupter unit 30, and also the right-hand end of the mechanism housing 34, as shown in FIG. 41. The open-circuit gap distance between the opened contacts 150, 151 (FIG. 5) within the interrupter unit 30 may be increased slightly to be able to withstand the fully-open circuit line-voltage, even in the absence of the use of a disconnecting switchblade 8. In other words, the device of FIG. 51 may have its dimensions slightly enlarged to eliminate the necessity of utilizing a serially-related disconnecting switchblade 8, as was the case in FIG. 4 of the drawings.

The operating mechanism 35 of FIG. 41 is identical to that heretofore described; consequently, a further description thereof appears unnecessary. The important fact to notice is that in the device of FIG. 41, a disconnecting-switch structure 2 is not utilized, but nevertheless the improved advantageous features of the interrupter mechanism 35 may, nevertheless, be utilized to advantage.

The improved operating mechanism 35 of the present invention may be employed with a medium fault-break switch, or a load-break switch, alternatively, or for particular applications, where the utility customer desires to view an open visible condition of the switch structure 2, and therefore a series disconnecting switchblade 8 is deemed desirable, from a safety standpoint, the present novel mechanism 35 is also suitable not only to effect the opening and closing movements of the separable interrupter switch contacts 31, but the improved mechanism 35 may be additionally be employed for operation of the opening and closing movements of the disconnecting switchblade 8 of the series-utilized disconnecting switch structure 2.

Thus, the operating mechanism 35 of the present invention may be of universal application for load-break switch operation, medium fault-break switch operation, or utilized for conjoint cooperative action between an interrupter-switch 30 and an electrically series-related disconnected switch structure 2 to provide an open visible break when the device is in the open-circuit position.

Figure 43:
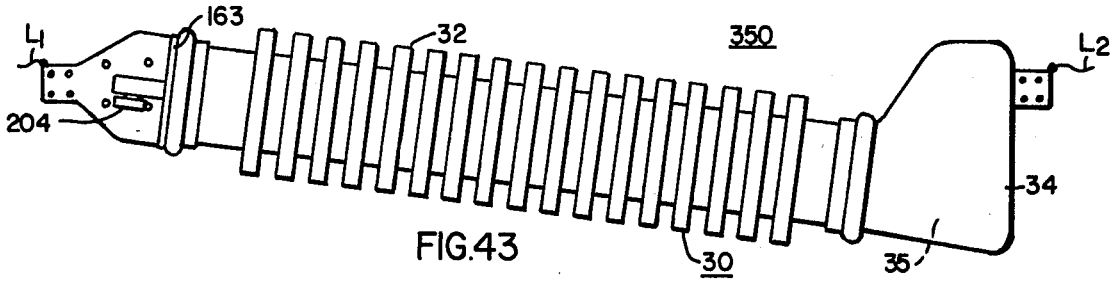
Figure 42:
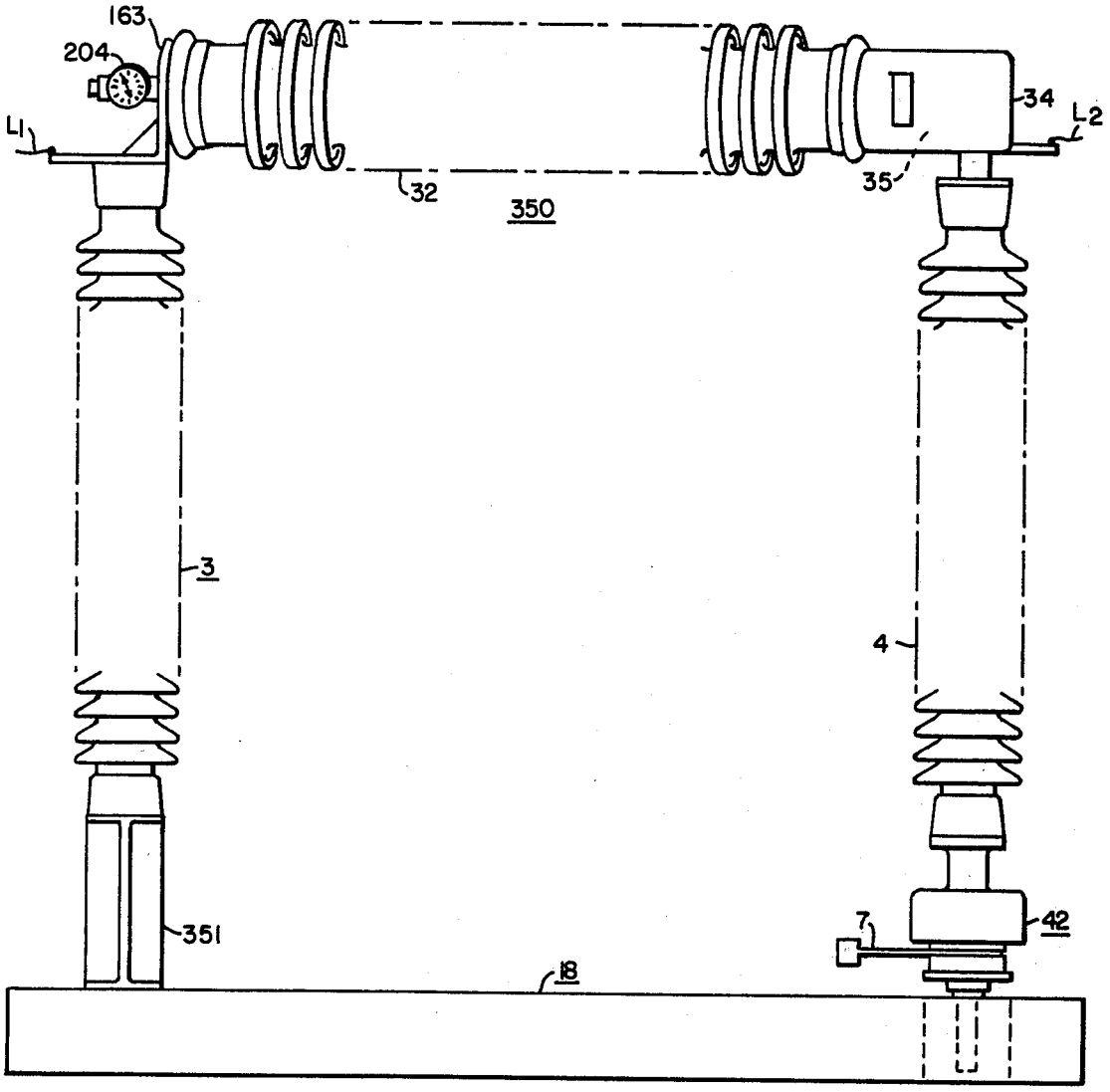
FIG. 42 illustrates a new type of electrical device, herein termed a "circuit protector," having a rating only slightly below that of a power circuit-breaker, the device being illustrated in the closed-circuit position; and, FIG. 43 illustrates a top-plan view of the "circuit protector" of FIG. 42, the device of FIGS. 42 and 43 utilizing the same mechanism as employed in the circuit-interrupting structure as set forth in FIGS. 5 and 12.

Reference is made to FIGS. 42 and 43 of the drawings, wherein there is illustrated a new type of circuit-interrupting device, incorporating some of the principles of the present invention, and constituting a new piece of equipment heretofore unavailable in the electrical art. This new class of circuit-interrupting device is designated herein as a "circuit protector." It is intended to fulfill a need in electrical utility systems for which, currently, no electrical device is presently available.

Basically, the new type of device includes a circuit-interrupting element 30, preferably of the sulfur-hexafluoride ($SF_6$) type, constituting a ($SF_6$) puffer-type interrupter, and an operating mechanism 35, which is disposed at line-potential, the device being supported up in the air an adequate distance to withstand the rated voltage, and supported upon two insulating columns 3, 4. Except for these two insulating columns 3, 4 (which may be conventional station-post or cap-and-pin assemblies), there are no other connections from live parts to ground. From the standpoint of performance and application, this device is not a circuit-breaker, a recloser, a load-break switch, or a circuit-switcher. (3,163,736 — mikos et al; 3,588,406 — Bernatt; 3,227,925 — Cook).

In the following description pertaining to FIGS. 42 and 43, some typical applications are mentioned. The circuit protector 350, as illustrated in FIGS. 42 and 43, can be used in power-circuits to switch transformers, lines and cables. It is capable of switching load-magnetizing, charging and fault currents. The fault-current capability is limited, at the present time, to 10,000 amps. This device is also suitable for switching capacitor banks and reactors. Tables I, II, and III thereinafter set forth, list the results of the tests performed on a single-pole prototype of the circuit protectors 350 switching fault currents, capacitor banks, and magnetizing currents respectively. Short-time current ratings are 61,000 amps. momentary, and 40,000 amps. at 4 seconds. Fault-closing rating is 40,000 amps., and the rated current is 1,200 amps. The voltage rating of the circuit protector, as shown in FIGS. 42 and 43 are, currently, 69 KV, 115 KV, 138 KV and 161 KV.

With reference to Table I, set forth below, which shows short-circuit current-interrupting tests, it will be noted that the recovery voltage in kilovolts is indicated in the left-hand column, the symmetrical current is indicated in thousands of amperes in the second column, the asymmetrical current in kiloamperes is indicated in the third column, the transient-recovery voltage is indicated in the fourth column in kilovolts per microsecond. All interruptions were completed within five cycles.

TABLE I

| Recovery Voltage (KV) | Symmetrical Current (RMS KA) | Asymmetrical Current (RMS KA) | TRV (1-COS) (KV/μSec.) | Notes |
|---|---|---|---|---|
| 132 | 6 | 5.7-(Arc Time in miliseconds) | | |
| 132 | 6 | 5.9 | | |
| 132 | 8 | 14.4 | 1.57 | |
| 132 | 10 | 14.4 | 1.74 | |
| 132 | 10 | 14.1 | 1.76 | |
| 132 | 10 | 12.8 | 1.72 | 30° Later Trip |
| 132 | 10 | 11.4 | 1.72 | 30° Later Trip |
| 132 | 10 | 9.7 | 1.67 | 30° Later Trip |
| 132 | 10 | 8.6 | 1.67 | 30° Later Trip |
| 132 | 10 | 7.2 | 1.69 | 30° Later Trip |
| 132 | 10 | 22.4 | 1.70 | 30° Later Trip |
| 132 | 10 | 12.0 | 1.71 | 30° Later Trip |
| 132 | 10 | 11.4 | 1.74 | 30° Later Trip |
| 132 | 10 | 9.9 | 1.74 | 30° Later Trip |
| 129 | 10 | 15.5 | 12 | 90° Earlier Trip<br>90° Earlier Cl.Sw. |
| 130 | 10 | 15.1 | 13.2 | 360° Earlier Trip |
| 129 | 10 | 7.0 | 14 | 180° Earlier Trip |
| 128 | 10 | 9.2 | 14.6 | 42° Earlier Trip |
| 135 | 10 | | 14.3 | Same Timing |
| 128 | 10 | 9.5 | 14.6 | Same Timing |
| 128 | 10 | 13.3 | 14.6 | 90° Earlier Trip |
| 128 | 10 | 1.8 | 16.7 | 90° Earlier Trip |
| 128 | 10 | 3.7 | 16 | 42° Later Trip |
| 128 | 10 | 14.1 | 16 | 42° Later Trip |
| 128 | 10 | 13.8 | 16 | 180° Later Trip<br>180° Later Cl. Sw. |

With reference to Table II, set forth below which sets forth the results of capacitor testing, the capacitance current is indicated in column 1, the test circuit voltage in kilovolts in the closed and open-circuit positions of the switch 350 is indicated in columns 2 and 3.

TABLE II

| Capacitance Current (RMS Amperes) | Test Circuit Voltage (KV) Closed | Open | Notes |
|---|---|---|---|
| 550 | 114 | 91 | |
| 550 | 112 | 87.5 | 30° Later Trip |
| 550 | 112 | 87.5 | 30° Later Trip |
| 550 | 112 | 87.5 | 30° Later Trip |
| 550 | 112 | 87.5 | 30° Later Trip |
| 550 | 119 | 94 | 30° Later Trip |
| 550 | 119 | 94 | 30° Later Trip |
| 550 | 112 | 87.5 | 30° Later Trip |
| 280 | 57.5 | 45 | Same Timing- ½ Excitation |
| 550 | 112 | 87.5 | Same Timing |
| 550 | 112 | 87.5 | 30° Later Trip |
| 550 | 112 | 87.5 | 30° Later Trip |
| 550 | 112 | 87.5 | 30° Later Trip |
| 550 | 112 | 87.5 | 30° Later Trip |
| 550 | 112 | 87.5 | 30° Later Trip |
| 550 | 122 | 95 | Start of 161KV Tests |
| 550 | 125 | 100 | Repeat - Same Timing |

TABLE II-continued

| Capacitance Current (RMS Amperes) | Test Circuit Voltage (KV) Closed | Open | Notes |
|---|---|---|---|
| 550 | 125 | 100 | 30° Later Trip |
| 550 | 125 | 100 | 30° Later Trip |
| 550 | 131 | 102 | 30° Later Trip |
| 550 | 131 | 102 | 30° Later Trip |
| 550 | 131 | 102 | 30° Later Trip |
| 550 | 135 | 105 | 30° Later Trip |
| 550 | 135 | 105 | 30° Later Trip |
| 550 | 135 | 105 | 30° Later Trip |
| 550 | 131 | 102 | 30° Later Trip |
| 550 | 134 | 100 | 30° Later Trip |
| 550 | 132 | 100 | 30° Later Trip |
| 550 | 132 | 100 | 30° Later Trip |
| 550 | 135 | 100 | Reverse Leads |
| 550 | 132 | 100 | 30° Later Trip |
| 550 | 132 | 100 | 30° Later Trip |
| 550 | 135 | 100 | 30° Later Trip |
| 550 | 132 | 100 | 30° Later Trip |
| 550 | 132 | 100 | 30° Later Trip |
| 550 | 135 | 100 | 30° Later Trip |
| 550 | 132 | 100 | 30° Later Trip |
| 550 | 128 | 100 | 30° Later Trip |
| 550 | 132 | 100 | 30° Later Trip |
| 550 | 128 | 100 | 30° Later Trip |
| 550 | 135 | 100 | 30° Later Trip |
| 550 | 135 | 100 | 30° Later Trip |
| 350 | 68.5 | 53.5 | ½ Excitation - Back to Back |
| 750 | 169 | 122 | Full Excitation |
| 650 | 138 | 103 | 30° Later Trip |
| 650 | 132 | 100 | 30° Later Trip |
| 640 | 135 | 100 | 30° Later Trip |
| 640 | 132 | 100 | 30° Later Trip |
| 640 | 132 | 100 | 30° Later Trip |
| 640 | 132 | 100 | 30° Later Trip |
| 640 | 132 | 100 | 30° Later Trip |
| 640 | 132 | 100 | 30° Later Trip |
| 640 | 132 | 100 | 30° Later Trip |
| 650 | 133 | 102 | 30° Later Trip |
| 650 | 132 | 100 | 30° Later Trip |
| 650 | 131 | 100 | 30° Later Trip |
| 650 | 131 | 100 | Reverse Leads |
| 650 | 131 | 100 | Reverse Leads |
| 290 | 65 | 50 | 30° Later Trip |
| 580 | 129 | 100 | ½ Excitation 30° Later Trip |
| 560 | 125 | 100 | Full Excitation Same Timing |
| 580 | 123 | 100 | 30° Later Trip |
| 600 | 125 | 100 | 30° Later Trip |
| 600 | 130 | 100 | 30° Later Trip |
| 600 | 130 | 100 | 30° Later Trip |
| 600 | 130 | 100 | 30° Later Trip |
| 640 | 131 | 100 | 30° Later Trip |
| 640 | 131 | 100 | 30° Later Trip |
| 640 | 131 | 100 | 30° Later Trip |
| 620 | 135 | 100 | 30° Later Trip |

The last column in Tables I and II relate to initiating the opening operation of the switch in electrical degrees along the sinusoidal alternating-current wave. The test equipment had, of course, facility of varying the position of tripping the switch 350.

Table III, set forth below, shows the capability of the switch 350 in opening magnetizing currents of unloaded transformers. Again column 1 indicates the magnetizing current in amperes (RMS), column 2 indicates the recovery voltage in kilovolts, and the notes of column 3 indicate again the varying electrical position of initiating the opening operation of the switch.

TABLE III

| Magnetizing Current (RMS Amperes) | Recovery Voltage (KV) | Notes |
|---|---|---|
| 1.1 | 144 | |
| 1.3 | 132 | .08 Cycle Earlier Trip |
| 1.4 | 147 | .08 Cycle Earlier Trip |
| 1.1 | 146 | .1 Cycle Earlier Trip |
| 1.1 | 147 | .08 Cycle Earlier Trip |
| 1.1 | 144 | .08 Cycle Earlier Trip |
| 1.1 | 147 | .1 Cycle Earlier Trip |
| .8 | 72 | Changed Reactor in Attempt to get 3 Amperes. |
| 1.6 | 147 | " |
| 1.6 | 144 | " |
| 1.6 | 147 | " |

TABLE III-continued

| Magnetizing Current (RMS Amperes) | Recovery Voltage (KV) | Notes |
|---|---|---|
| 1 | 72 | New Transformer Setting ½ Excitation |
| 4.9 | 135 | Full Excitation |
| 3 | 117 | |
| 3 | 114 | .1 Cycle Later Trip |
| 3 | 117 | .08 cycle Later Trip |
| 3 | 117 | .08 Cycle Later Trip |
| 3 | 117 | .1 Cycle Later Trip |
| 3 | 117 | .08 Cycle Later Trip |
| 3 | 117 | .08 Cycle Later Trip |
| 5 | 129 | |
| 6 | 132 | |
| 6 | 132 | .08 Cycle Earlier Trip |
| 6 | 132 | .08 Cycle Earlier Trip |
| 6 | 132 | .1 Cycle Earlier Trip |

FIGS. 42 and 43 show a single pole-assembly of the circuit protector 350. It will be noted that the interrupter 30 and the mechanism 35 are supported by insulators 3 and 4. The insulator 4 acts also as a torsion-drive to operate the mechanism 35 and effect opening and closing motions of the separable contacts 31 within the interrupter 30. These separable contacts may be similar to the contact structure 31 as set forth in FIG. 5 of the drawings The insulator 4 is supported and driven by an accelerating trip-assembly 42, described in application Ser. No. 468,332, filed May 8, 1974 by Russell E. Frink, et al. and assigned to the assignee od the instant invention. The shunt-trip assembly 42 may, in turn, be bolted to a cranked turntable similar to that set forth in FIG. 7 of said patent application incorporated herein by reference, and driven by a connecting rod from a ground operator, not shown. The turntable and the spacer 351 supporting the insulator 3 are mounted upon the base 18.

The operation of the circuit protector 350 is as follows: the ground operator (usually mortor driven) causes the anti-clockwise rotation of the turntable, shunt trip 42, and torsion drive 4 by way of a connecting rod and crank mechanically connected to the turntable. This action causes the mechanism 35 closing springs to become charged, and at the end of approximately 120° of closing rotary motion, the closing springs 211, 212 are automatically released, and by this action the interrupter contacts 31 are operated to close.

The interrupter may be tripped to open by clockwise rotation of the torsion shaft 4. This can be accomplished by two methods:

(1) Energizing of the trip-coil within the shunt-trip assembly 42 of the foresaid Pat. Application Ser. No. 468,332.

(2) Energizing the ground operator 9 in the direction opposite to that of the closing operation.

The interrupter is tripped open at the very start of this opening operation, which as it continues, it resets the mechanism 35, and at the end, it recharges the shunt-trip springs and the device is ready for the next sequence of operation.

The circuit protector described in FIGS. 42 and 43 is for outdoor or for indoor application in open space. The support insulators 3 and 4, which may be of the station-post type or cap-and-pin type, would be of height as appropriate to the voltage rating of the device.

The closing operation counted from the moment of releasing the closing springs 211, 212 to the completion of motion within the interrupter 30, by closing of the separable contacts 31, therein, takes about 50 to 60 msec., as in a conventional circuit-breaker. However, the total duration, counted from the initiation of closing impulse to the ground operator 9, includes closing springs charging time of 3 to 5 seconds, depending upon the output of the ground operator 9, so that the total closing time is comparable to the closing time of a load-break switch. The opening operation, however, is comparable to that of a circuit-breaker, because the opening time of the circuit protector 350, from initiation of trip-impulse to arc extinction is 5 cycles of 60 Hz wave, and it can be made shorter for a very small increase in the cost.

In summarization, the circuit protector 350 of FIGS. 42 and 43 opens like a circuit-breaker, although its interrupting ratings are somewhat lower, and closes like a load-break switch. The cost of the circuit protector 350 of FIGS. 42 and 43 is estimated to represent a small fraction of a circuit-breaker cost of the same voltage rating, but as compared with a load-break switch, it is higher by a small percentage figure.

The foregoing two advantageous features, combined with the fact that at present there is no equipment on the market with the performance of a circuit protector 350, in the range of prices for which it can be marketed, makes the circuit protector 350 a novel power-switching device for the first time available to the electrical utility industry.

Although there have been illustrated and described specific structures, it is to be clearly understood that the same were merely for the purpose of illustration, and that changes and modifications may readily be made therein by those skilled in the art without departing from the spirit and scope of the invention.

What we claim is:

1. A circuit-interrupter and a serially-related disconnecting-switch structure, said circuit-interrupter including separable arcing contact means separable to establish arcing between the contacts, a common operating mechanism including a rotatable shaft for effecting the opening and closing movements of said separable arcing contact means and also said disconnecting-switch structure comprising additionally releasable closing energy-storing means, means for translating the rotative closing only during the closing operation of the circuit interrupter motion of said rotatable shaft into an increase of the energy-content stored within said closing energy-storing means during said closing operation, a toggle-linkage having a pair of interconnected toggle-links and a releasable knee-pin interconnecting said toggle-links, said toggle-linkage interconnecting said releasable closing energy-storing means with said separable arcing contact means, means for biasing the separable arcing contacts to the open-circuit position, first releasing means for said releasable knee-pin, tripping means responsive to reverse opening rotation of said shaft or effecting the release of said first releasing means to release the releasable knee-pin to thereby effect collapse of the toggle-linkage and thereby effect the opening of the separable arcing contacts, second releasing means for discharging the stored energy of said closing energy-storing means to effect the straightening of said toggle-linkage and consequent closing of the separable arcing contacts during the closing operation, means whereby the operation of said rotatable shaft-member additionally effects the closing and opening operations of said serially-related disconnecting-switch structure, and the separable arcing contacts remaining open in the fully-open-circuit position of the circuit-interrupter and disconnecting switch structure.

2. The combination according to claim 1, wherein the closing rotative motion of the operating shaft first closes the disconnecting contacts associated with the disconnecting-contact structure prior to the operation of the second releasing means for discharging the stored energy of said closing energy-storage means to effect the straightening of said toggle-linkage and the consequent closing of the separable arcing contacts within the circuit-interrupter, such action taking place subsequent to the closing of the disconnecting-switch contacts.

3. The combination according to claim 1, wherein during the opening operation the tripping means effects release of the first releasing means to release the releasable knee-pin prior to a separation of the disconnecting-switch contacts of the disconnecting-switch structure.

4. The combination according to claim 1, wherein the rotatable shaft extends completely through the mechanism housing enclosing said common operating mechanism, and the extension of said rotatable shaft protruding externally of the mechanism housing has an operating crank-arm affixed thereto to function in opening and closing the serially-related disconnecting-switch contacts.

5. In combination, a circuit-interrupter and a serially-related disconnecting switch structure, said circuit-interrupter including separable arcing contacts, said disconnecting-switch structure including a pair of separable disconnecting-switch contacts, a common operating mechanism including a movable operating member for effecting the closing and opening movements of said separable arcing contact means of the circuit-interrupter comprising releasable closing energy-storing means, means for translating the closing motion of said movable operating member only during the closing motion of said movable operating member into an increase of the energy-content stored within said closing energy-storing means, a toggle-linkage having a pair of interconnected toggle-links and a releasable knee-pin interconnecting said toggle-links, said toggle-linkage interconnecting said releasable closing energy-storing means with said separable arcing contact means within the circuit-interrupter, opening biasing means for biasing the separable arcing contacts within the circuit-interrupter to the open-circuit position, first releasing means for said releasable knee-pin, tripping means for effecting release of said first releasing means to release the releasable knee-pin to thereby effect collapse of the toggle-linkage and consequent opening of the separable arcing contacts within the circuit-interrupter, second releasing means for discharging the stored energy of said closing energy-storing means to effect the straightening of said toggle-linkage and a consequent closing of the separable arcing contacts within the circuit-interrupter, the movements of said movable operating member additionally effecting the opening and closing movements of the switch-contacts of the serially-related disconnecting-switch structure, and the separable arcing contacts remaining open in the fully-open-circuit position of the circuit-interrupter and disconnecting switch structure.

6. The combination according to claim 5, wherein during the closing operation the motion of said movable operating member effects first a closing of the disconnecting-switch contacts prior to the subsequent closing of the separable arcing contacts within the circuit-interrupter.

7. The combination according to claim 5, wherein during the opening operation the tripping means is actuated to effect the release of the first releasing means to effect opening of the separable arcing contacts within the circuit-interrupter prior in point of time to the separation of the switch-contacts of the serially-related disconnecting-switch structure.

8. The combination according to claim 5, wherein the closing energy-storing means comprises spring-means interposed between a pair of yoke members, and the closing movement of the operating shaft effects the compressive closing rotation of one of the yoke members to effect thereby compression of said springs to increase the energy-content stored within the spring structure only during the closing operation.

9. The combination according to claim 5, wherein the closing energy-storing means includes a pair of yoke members having spring means interposed therebetween, and closing motion of the movable operating member effects closing movement of one yoke member toward the other yoke member to consequently compress the spring-means interposed therebetween to thus increase the energy-content of the energy-storing means only during the closing operation.

10. The combination according to claim 8, wherein one or more hook-levers maintains the springs in their compressed state, and said second releasing means includes one or more releasing pin-members for disengaging said one or more hook-levers to thereby permit the discharge of the stored energy within the closing energy-storing means to effect the straightening of said toggle-linkage and thus closing of the separable arcing contacts within the circuit-interrupter.

11. A circuit-interrupting assemblage including a circuit-interrupter unit and a serially-related disconnecting-switch structure, said circuit-interrupter unit including separable arcing contact means separable to establish arcing between the separable contacts, said serially-related disconnecting-switch structure having only a single disconnecting-switch blade includable therewith, a common operating mechanism disposed adjacent one end of said circuit-interrupter unit and including a rotatable shaft for effecting the opening and closing movements of said separable arching contact means and also additionally, rotative movement of said single disconnecting switch-blade associated with said disconnecting-switch structure, said common operating mechanism also comprising a relatively-strong, releasable, closing energy-storing means, means for translating the rotative, closing motion of said rotatable operating shaft only during the closing operation of the circuit-interrupter into a steady increase of the energy content stored within said relatively-strong, closing, energy-storing means during a substantial portion of the closing operation of the device, linkage means interconnecting said relatively-strong, closing, energy-storing means with said separable arcing contact means disposed within said circuit-interrupting unit, releasing means for releasing a portion of the stored energy of said energy-storing means to effect thereby rapid contact closure of said separable arcing contacts within the circuit-interrupting unit, means biasing said arcing contacts to their open-circuit position, said releasing means withdrawing a portion of the energy stored in said closing energy-storing means to effect a charging of the opening biasing means for said separable arching contacts so that in the closed-circuit position of the device, with the arcing contacts closed and the disconnecting contacts closed, the opening biasing means is, at this point in time, charged, tripping means to effect a release of the opening biasing means for the separable arcing contacts within the interrupter unit during the opening operation of the device, said separable arcing contacts within the interrupter unit and the disconnecting contacts both being open in the fully open-circuit position of the device to thereby interpose two series breaks into the controlled circuit, means for effecting first a closure of the separable disconnecting switch contacts during the closing operation of the device and subsequently a later closing of the separable arcing contacts disposed within the circuit-interrupter unit, whereby preignition arcing doing closing is confined solely within said circuit-interrupter unit and is not permitted to occur at the separable disconnecting switch contacts, and the reverse rotative travel of said operating shaft not only effecting the actuation of said tripping means during the initial portion of the opening rotative travel of said rotatable operating shaft but continued opening travel of said rotatable operating shaft, following tripping, effecting a disconnecting operation of the single disconnecting switch-blade to effect the opening separation of the disconnecting-switch contacts, and the common operating mechanism effecting first a closure of the disconnecting switch contacts during the closing operation followed by a subsequent closing of the separable arcing contacts within the interrupter unit during such a closing operation.

12. In combination, a circuit-interrupter unit and a serially-related disconnecting-switch structure, means supporting said circuit-interrupter unit and said serially-related disconnecting-switch structure up in the air an adequate distance and height away from ground potential, said circuit-interrupter unit including separable arcing contacts, said disconnecting-switch structure including a pair of separable disconnecting-switch contacts, means defining a common operating mechanism disposed at high voltage and adjacent one end of said circuit-interrupting unit including a movable operating member for effecting the closing and opening movements of said separable arcing contact means of the circuit-interrupter unit comprising releasable, relatively-strong, closing, energy-storing means, means for translating the closing motion of said movable operating member during a substantial portion only of the closing operation of said movable operating member into an increase of the energy content stored within said relatively-strong, closing, energy-storing means, linkage means interconnecting said releasable, relatively-strong, closing, energy-storing means with said separable arcing contact means disposed within the circuit-interrupter unit, biasing means for biasing the separable arcing contacts disposed within the circuit-interrupter unit to the open-circuit position, tripping means for effecting a release of the energy content within the closing energy-storing means to affect thereby a rapid closing of the separable arcing contacts and also a charging of the biasing means for biasing the said arcing contacts to their open-circuit position, the movement of said movable operating member, in addition to charging the closing, energy-storing means, also effecting operation of said disconnecting-switch structure, said disconnecting-switch structure having only a single, rotatable, disconnecting-switch blade associated therewith, the separable arcing contacts and the separable disconnecting-switch contacts remaining open during the opening operation of the device to effect thereby two serially-related breaks into the controlled circuit during the open-circuit position of the device, means causing the opening movement of said movable operating member to first effect a tripping operation, thereby releasing the biasing means for the separable arcing contacts to effect their quick opening during such an opening operation of the device, and a further continued closing movement of the movable operating member to effect subsequently the opening of the separable disconnecting-switch contacts, and the opening operation effecting first an opening of the separable arcing contacts and a later opening of the disconnecting-switch contacts.

13. The combination according to claim 12, wherein the linkage means includes a toggle-linkage having a pair of interconnected toggle-links and a releasable knee-pin interconnecting said toggle-links.

14. A circuit-protector comprising a circuit-interrupting assemblage, a serially-related disconnecting-switch structure and a common operating mechanism therefor, said disconnecting-switch structure having only a single roatatable disconnecting switch-blade associated therewith, means supporting said circuit-protector up in the air a substantial distance and height from ground potential, said common operating mechanism being disposed at high voltage adjacent one end of the circuit-interrupting assemblage, said circuit-interrupting assemblage comprising a pair of separable arcing contacts, said disconnecting-switch structure including a pair of separable disconnecting-switch contacts, one of which is at the free end of said rotatable, single, disconnecting switch-blade, said common operating mechanism being disposed at high voltage at one end of said circuit-interrupting assemblage including relatively-strong, closing, energy-storing means and a relatively-weak, opening, biasing means for biasing the separable arcing contacts to the open-circuit position within said circuit-interrupting assemblage, means effective only during the closing operation of the circuit-protector to effect an increase of the energy content within the relatively-heavy, closing, energy-storing means, linkage means interconnecting the separable arcing contacts with said relatively-strong, closing, energy-storing means, means functioning only during a substantial portion of the closing operation of the device for transferring a portion of the closing energy from the relatively-strong, closing, energy-storing means to said relatively-weak, opening biasing means for the arcing contacts to quickly close said arcing contacts and charge said relatively-weak, opening, biasing means, the assemblage functioning so as to have both the arcing contacts and the separable disconnecting-switch contacts open in the fully-open-circuit position of the circuit-protector to interpose thereby two breaks into the controlled circuit in the open-circuit position thereof, said common operating means functioning also during a substantial portion of the closing operation, only of said device to first effect a closing of the separable contacts of the disconnecting-switch structure, and, subsequently, in point of time, a later closing of the separable arcing contacts disposed within the circuit-interrupting assemblage whereby any prearcing occurring during the closing operation of the device will take place only within the circuit-interrupting assemblage and not at the separable disconnecting-switch contacts.

15. A circuit-interrupting assemblage comprising, in combination, an interrupting unit having separable arcing contacts and a serially-related disconnecting switch structure having separable switch contacts, a common operating mechanism therefor all located at high-voltage, insulating means for supporting said circuit-interrupting assemblage with said common operating mechanism up in the air an adequate distance from ground potential to withstand the applied line voltage, means including said common operating mechanism for effecting the opening and closing movements of said separable arcing contacts and also said disconnecting switch contacts, said common operating mechanism comprising an opening accelerating spring for biasing said pair of separable arcing contacts to the open-circuit position and a toggle-linkage supplied for actuating said separable arcing contacts, said common operating mechanism additionally providing a separate charging closing spring independent from said opening accelerating spring, motion of at least a portion of said insulating means effecting a consequent charging of said independent separate charging closing spring, means within said operating mechanism operable during a predetermined time in the closing motion of said insulating portion to effect sudden release of said separate charging closing spring to thereby effect compression of said opening accelerating spring and extension of said toggle means to thereby close said separable arcing contacts and additionally to maintain said separable arcing contacts in the closed-circuit position and, finally, subsequent closing of said disconnecting switch contacts, releasable latching means for said toggle means to effect a subsequent, in point of time, tripping, opening collapsing of said extended toggle means and a consequent opening of said separable arcing contacts during a subsequent opening operation of the circuit-interrupting assemblage to the fully-open-circuit position of the interrupting unit and a subsequent opening of the disconnecting switch contacts, and additional means within said interrupting unit for extinguishing the arc established within said interrupting unit at said separable arcing contacts during the opening operation of the circuit-interrupting assemblage.

16. A circuit-interrupting assemblage comprising, in combination, means defining an interrupting unit having separable arcing contacts and means defining a serially-related disconnecting switch structure having separable switch contacts, the electrical circuit passing serially first through the interrupting unit and then sequentially through the serially-related disconnecting switch structure so that a safe, open, gap may exist between the disconnecting switch contacts in the fully-open-circuit position of the circuit-interrupting assemblage, means defining a common operating mechanism disposed adjacent the hinge end of the disconnecting-switch structure and at one end of the interrupting unit, the assemblage comprising said common operating mechanism, said interrupting unit and said serially-related disconnecting switch structure all being located high up in the air at high voltage, insulating means including a plurality of column-type, upstanding, insulating structures for supporting said circuit-interrupting assemblage, thereby supporting all of the component parts of said circuit-interrupting assemblage high up in the air an adequate distance from ground potential to thereby withstand the applied line-circuit voltage, means including a rotation at one of said upstanding insulating column structures for operating said common operating mechanism for effecting first an opening of the separable arcing contacts within the interrupting unit during the opening operation of the circuit-interrupting assemblage, followed thereafter by a swinging upward opening of the disconnecting switchblade of the serially-related disconnecting switch structure, said common operating mechanism also functioning, during the closing operation of the circuit-interrupting assemblage, to first effect a closing of the disconnecting-switch contacts, and followed thereafter by subsequent closing of the separable arcing contacts within the interrupting unit during such a closing operation, so that any pre-arcing will occur within the interior of the interrupting unit at said separable arcing contacts, and not at the open, exposed, disconnecting-switch contacts, said common operating mechanism including an opening accelerating spring for biasing said pair of separable arcing contacts within the interrupting unit to the open-circuit position, with a first toggle linkage for controlling said biasing means, said common operating mechanism, additionally, providing a separate, charging, closing spring, independent from said opening accelerating spring, and charged only during the closing operation of said operating mechanism, said common operating mechanism functioning to first translate rotation of said upstanding rotatable insulator column to a compression of said main closing spring while restrainig the release of said first toggle linkage, until a predetermined point during the closing operation, after the disconnecting switch contacts have closed, whereupon release of said first-mentioned toggle means effects simultaneously an extension of said toggle means, and a consequent closing of said separable arcing contacts together with a charging of the opening accelerating closing spring, whereby in the closed-circuit position of the separable arcing contacts in the closed circuit position of the circuit interrupting assemblage the opening accelerating spring is completely charged and in readiness for an immediate tripping operation, means interrelating a reverse rotation of said insulating rotatable column structure to effect a tripping and collapsing of said first-mentioned toggle structure, to thereby permit the opening accelerating spring to effect an immediate opening of said separable arcing contacts within the interrupting unit, and continued reverse rotation of the rotatable insulating column structure will subsequently effect an opening of the electrically serially-related disconnecting switch contacts, so that in the fully-open-circuit position of the circuit-interrupting assemblage, the disconnecting switch contacts will remain open, and, additionally, the separable arcing contacts will likewise remain open, thereby maintaining an open-circuit condition of all of the separable series contacts, both arcing contacts and disconnecting-switch contacts.

17. The combination according to claim 16, wherein the closing spring charging structure comprises a pair of relatively-movable yoke structures having at least one compression spring interposed therebetween, and one of said yoke structures is responsive to rotation of the upstanding, rotatable column structure.

18. The combination according to claim 17, wherein one of said yoke structures includes trunnion pins, to which said toggle linkage is pivotally connected.

19. The combination according to claim 18, wherein a pair of hook-links (209) are pivoted upon the operating shaft in alignment with the upstanding rotatable insulating column structure, and said hook-links (209) are tripped by means rotatable with said one yoke structure to release said trunnion pins.

20. A circuit-interrupting assemblage including a circuit-interrupter unit and a serially-related disconnecting switch structure, said circuit-interrupter unit including separable arcing contact means separable to establish arcing between the separable contacts, a common operating mechanism including a rotatable shaft for effecting the opening and closing movements of said separable arcing contact means and also, additionally, said disconnecting-switch structure comprising, unitarily, relatively-strong, releasable, closing energy-storing means, means for translating the rotative, closing, only during the closing operation of the circuit-interrupter motion of said rotatable shaft, into an increase of the energy content stored within said relatively-strong, closing, energy-storing means during a large portion of said closing operation, releasable collapsible linkage means interconnecting said releasable, relatively-strong, closing, energy-storing means with said separable arcing contact means disposed within said circuit-interrupting unit, relatively-weak means for biasing the separable arcing contacts within said circuit-interrupting unit to the open-circuit position, first releasing means for releasing said collapsible linkage means interconnecting the closing energy-storing means with said separable arcing contact means, tripping means responsive to a reverse opening rotation of said rotatable shaft for effecting the release of said first releasing means to release the collapsible linkage means to thereby effect collapse of the said linkage means and thereby effecting the opening of the separable arcing contacts disposed within said circuit-interrupting unit, second releasing means for discharging the stored energy content of said relatively-strong, closing, energy-storing means to effect a closing condition of said collapsible linkage means and cause thereby a consequent closing of the separable arcing contacts within said circuit-interrupting unit during the closing operation of the assemblage, means whereby the rotation of said rotatable shaft member additionally effects the closing and operations of said serially-related disconnecting-switch structure, and both the separable arcing contacts and the disconnecting switch contacts remaining in the open-circuit position with gaps interposed between the contact structures thereof in the fully-open-circuit position of the circuit-interrupting assemblage.

21. The combination according to claim 20, wherein the collapsible linkage means, interconnecting the relatively-strong, closing, energy-storage means and the separable arcing contacts within the circuit-interrupting unit, comprises a toggle-linkage having a pair of interconnected toggle-links and a releasable knee-pin interconnecting said toggle links.

22. The combination according to claim 20, wherein the relatively-strong, closing, energy-storing means includes relatively-heavy compression springs which are compressed during substantially the entire closing operation to increase the energy content therein, and the relatively-weak biasing means for biasing the separable arcing contacts to the open-circuit position includes a relatively-weak compression spring.

23. The combination according to claim 20, wherein the common operating mechanism functions to sequentially first close the separable disconnecting-switch contacts and at a later point in time closes the separable arcing contacts disposed within the circuit-interrupting unit.

24. In combination, a circuit-interrupter and a serially-related disconnecting-switch structure, said circuit-interrupter including separable arcing contacts, said disconnecting-switch structure including a pair of separable disconnecting-switch contacts, a common operating mechanism including a movable operating member for effecting the closing and opening movements of said separable arcing contact means of the circuit-interrupter comprising releasable, relatively-strong, closing energy-storing means, means for translating the closing motion of said movable operating member only during the closing operation of said movable operating member into an increase of the energy content stored within said relatively-strong, closing energy-storing means, collapsible linkage means interconnecting said releasable, relatively-strong, closing energy-storing means with said separable arcing-contact means disposed within the circuit-interrupter, relatively-weak, opening biasing means for biasing the separable arcing contacts disposed within the circuit-interrupter unit to the open-circuit position, first releasing means for said collapsible linkage means, tripping means for effecting release of said first releasing means to thereby release the collapsible linkage means to effect thereby consequent opening of the separable arcing contacts within the circuit-interrupter, second releasing means for discharging the stored energy of said relatively-strong, closing energy-storing means to effect thereby the condition of said collapsible linkage means to a closed contact position, the movements of said movable operating member, additionally effecting the opening and closing movements of the separable switch contacts of the serially-related disconnecting-switch structure, the separable arcing contacts remaining open in the fully-open-circuit position of the circuit-interrupter as well as the separable contacts of the disconnecting switch structure, thereby interposing two open-circuit gaps between the several contact structures in the fully-open-circuit position of the circuit-interrupter, and means during the closing operation of the circuit-interrupter assemblage to effect initially a closed-circuit condition at the separable contacts of the disconnecting-switch structure followed by a subsequent, in point of time, closing of the arcing contacts within the circuit-interrupting unit.

25. The combination according to claim 24, wherein the collapsible linkage means includes a toggle linkage having a pair of interconnected toggle-links and a releasable knee-pin interconnecting said toggle-links.

26. The combination according to claim 24, wherein the relatively-strong, closing, energy-storing means includes a relatively-heavy compression spring which is compressed during the closing operation during a large portion of a closing movement of said movable operating member, and the opening biasing means for the arcing contacts includes a relatively-weak compression spring.

27. A circuit protector comprising a circuit-interrupting assemblage, a serially-related disconnecting switch structure and a common operating mechanism therefor, all disposed at high voltage, insulating means for supporting said component parts up in the air an adequate distance upwardly from ground potential to withstand the applied line-voltage, said circuit-interrupting assemblage comprising a pair of separable arcing contacts, said disconnecting-switch structure including a pair of separable disconnecting-switch contacts, said common operating mechanism including relatively-strong, closing, energy-storing means and a relatively-weak, opening, biasing means for biasing the separable arcing contacts to the open-circuit position, means effective, only during the closing operation of the interrupting assemblage, to effect an increase of the energy content within the relatively-heavy closing energy storing means, linkage means interconnecting the separable arcing contacts with said relatively-strong, closing, energy-storing means, means functioning during the closing operation of the device for transferring a portion of the closing energy from the relatively-strong, closing, energy-storing means to said relatively-weak opening-biasing means for the arcing contacts to close said contacts, the assemblage functioning so as to have both the arcing contacts and the disconnecting-switch contacts open in the fully-open-circuit position of the circuit-interrupting assemblage, said common operating means functioning during the closing operation of the device to first effect a closing of the separable contacts of the disconnecting-switch structure and subsequently, in point of time, a later closing of the arcing contacts disposed within the circuit-interrupting unit, whereby any pre-arcing occurring during the closing operation of the device will take place only within the circuit-interrupting unit and not as the separable disconnecting-switch contacts.

28. The combination according to claim 27, wherein the relatively-strong, closing, energy-storing-means comprises one or more relatively-heavy compression springs which are steadily compressed by closing operating movement of the operating member during the closing operation of the device, and, additionally, the opening biasing means for the arcing contacts includes a relatively-weak compression spring.

29. The combination according to claim 27, wherein the collapsible linkage means includes a pair of toggle-links interconnected by a knee-pin, and first releasing means are provided to effect a transfer of energy from the relatively-strong, closing, energy-storing means to the opening biasing means at an intermediate point during the closing operation, and said common operating mechanism functioning during the closing operation to first close the disconnecting-switch contacts during the closing operation prior, in point of time, to a subsequent closing of the arcing contacts during such a closing operation.

30. The combination according to claim 27, wherein three upstanding supporting insulating column structures are utilized to support the entire device up in the air, the end-supporting columns being relatively fixed, and the intermediate middle upstanding insulating column being rotatable to thereby effect the opening and closing movements of said common operating mechanism at line potential for the circuit-interrupting assemblage.

* * * * *